US011885556B2

(12) United States Patent
Kang et al.

(10) Patent No.: US 11,885,556 B2
(45) Date of Patent: Jan. 30, 2024

(54) REFRIGERATOR

(71) Applicant: LG Electronics Inc., Seoul (KR)

(72) Inventors: Chanuk Kang, Seoul (KR); Sanghyun Cheon, Seoul (KR)

(73) Assignee: LG Electronics Inc., Seoul (KR)

( * ) Notice: Subject to any disclaimer, the term of this patent is extended or adjusted under 35 U.S.C. 154(b) by 457 days.

(21) Appl. No.: 17/234,034

(22) Filed: Apr. 19, 2021

(65) Prior Publication Data

US 2021/0325104 A1 Oct. 21, 2021

(30) Foreign Application Priority Data

Apr. 17, 2020 (KR) ..... 10-2020-0046626

(51) Int. Cl.

| | |
|---|---|
| ***G06F 1/16*** | (2006.01) |
| ***H05K 5/00*** | (2006.01) |
| ***H05K 7/00*** | (2006.01) |
| ***F25D 23/02*** | (2006.01) |
| ***F25D 27/00*** | (2006.01) |
| ***F25D 29/00*** | (2006.01) |

(52) U.S. Cl.

CPC ..... *F25D 23/028* (2013.01); *F25D 23/025* (2013.01); *F25D 27/005* (2013.01); *F25D 29/005* (2013.01); *F25D 2400/18* (2013.01); *F25D 2400/361* (2013.01)

(58) Field of Classification Search

CPC .. F25D 23/8028; F25D 23/025; F25D 27/005; F25D 29/005

See application file for complete search history.

(56) References Cited

U.S. PATENT DOCUMENTS 6,430,946 B2 * 8/2002 Roh ..... F25D 23/00 62/298
7,686,127 B2 * 3/2010 LeClear ..... F25D 23/12 181/150

(Continued)

FOREIGN PATENT DOCUMENTS

| | | |
|---|---|---|
| EP | 3327386 | 5/2018 |
| EP | 3333517 | 6/2018 |

(Continued)

OTHER PUBLICATIONS

Extended European Search Report in European Appln. No. 21168885.8, dated Sep. 14, 2021, 7 pages.

*Primary Examiner* — Anthony M Haughton
(74) *Attorney, Agent, or Firm* — Fish & Richardson P.C.

(57) ABSTRACT

A refrigerator includes a frame on which a panel assembly is mounted in a door provided with a panel assembly of which the inside thereof is visible, and a screen is output. The frame includes a panel assembly mounting part opened so that the panel assembly is mounted; a barrier configured to partition the inside of the door into a PCB accommodating space, in a PCB is disposed, and an insulator accommodating space, in which the insulator is disposed; and a cable guide part which is connected to the panel assembly mounting part and in which a cable configured to connect the panel assembly to the PCB is disposed. A frame cover configured to connect the cable guide part to the barrier in the insulator accommodating space and to guide the cable of the cable guide part into the PCB accommodating space is mounted on the frame.

20 Claims, 19 Drawing Sheets

(56) References Cited

U.S. PATENT DOCUMENTS

| | | | | |
|---|---|---|---|---|
| 7,810,343 | B2 * | 10/2010 | McCoy | F25C 5/22 62/331 |
| 7,980,088 | B2 * | 7/2011 | LeClear | H01R 31/06 62/331 |
| 2012/0285089 | A1 * | 11/2012 | Artwohl | A47F 3/0434 49/70 |
| 2015/0276302 | A1 * | 10/2015 | Roh | G02F 1/133377 62/127 |
| 2015/0362768 | A1 * | 12/2015 | Dunn | G02B 6/0095 349/65 |
| 2016/0003519 | A1 * | 1/2016 | Kim | F25D 29/005 49/70 |
| 2017/0191745 | A1 * | 7/2017 | Choi | F25D 23/028 |
| 2018/0149420 | A1 * | 5/2018 | Lee | H05K 7/1427 |
| 2018/0335252 | A1 * | 11/2018 | Oh | F25D 29/00 |
| 2018/0363970 | A1 * | 12/2018 | Koo | F25D 17/04 |
| 2022/0341245 | A1 * | 10/2022 | Shin | E05F 15/619 |

FOREIGN PATENT DOCUMENTS

| | | |
|---|---|---|
| EP | 3378359 | 9/2018 |
| EP | 3524908 | 8/2019 |
| KR | 1020180067391 | 6/2018 |
| KR | 20200006605 | 1/2020 |

* cited by examiner

REFRIGERATOR

CROSS-REFERENCE TO RELATED APPLICATION

The present application claims priority to Korean Patent Application No. 10-2020-0046626 (Apr. 17, 2020), the disclosure of which is hereby incorporated by reference in its entirety.

TECHNICAL FIELD

The present disclosure relates to a refrigerator.

BACKGROUND

In general, refrigerators refer to home appliances in which food may be stored in an internal storage space, which is shielded by a door, at a low temperature. For this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door that opens and closes the storage space.

In general, the refrigerator has a problem in that when the door is not opened, internal food may not be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve such a limitation, a refrigerator has been developed while allows a portion of a door thereof to be transparent or allows the inside thereof to be visible from the outside.

In some refrigerators, a panel assembly through which the inside of a refrigerator is visible and on which a screen is output is provided on a door of the refrigerator. Also, a structure in which a PCB controlling an operation of the panel assembly is provided on an end of the door is disclosed.

However, in the refrigerator having the above-described structure, to dispose a cable connecting a display to the PCB, an insulator is not filled in a space above the panel assembly, thereby deteriorating insulation performance.

SUMMARY

Embodiments provide a refrigerator capable of maintaining insulation performance of a refrigerator door in which a panel assembly through which the inside of the refrigerator is visible and on which a screen is output is disposed.

Embodiments also provide a refrigerator in which wires of a panel assembly provided in a door are easily arranged, and assembly and service workability are improved.

Embodiments also provide a refrigerator in which a cable configured to connect a panel assembly to a PCB is prevented from being damaged.

Embodiments also provide a refrigerator in which an arranged space of a cable configured to connect a display to a PCB, which are provided in a door is secured while satisfying insulation of the door.

Particular implementations of the present disclosure provide a refrigerator that includes a cabinet defining a storage space, and a door configured to open and close the storage space. The door includes an outer plate, a door liner, a panel assembly, an insulator, a frame, and a frame cover. The outer plate at least partially defines a front surface of the door and defines a plate opening. The door liner at least partially defines a rear surface of the door and defines a liner opening. The panel assembly is configured to shield the plate opening and the liner opening. The panel assembly includes a display configured to (i) permit an inside of the refrigerator to be visible from an outside of the panel assembly, and (ii) output a screen through the display. The insulator is disposed at the door. The frame is positioned at a periphery of the panel assembly. The frame cover is mounted at the frame. The frame includes a panel assembly mounting part, a barrier, and a cable guide part. The panel assembly mounting part mounts the panel assembly thereat. The barrier partitions an inside of the door into (i) a printed circuit board (PCB) accommodating space that accommodates a PCB, and (ii) an insulator accommodating space that accommodates the insulator. The cable guide part is connected to the panel assembly mounting part and configured to receive a cable. The cable connects the panel assembly to the PCB. The frame cover connects the cable guide part to the barrier in the insulator accommodating space and guides the cable from the cable guide part into the PCB accommodating space.

In some implementations, the refrigerator can optionally include one or more of the following features. The cable guide part may be recessed from a front surface of the frame and accommodates the cable. The cable guide part may include a cable inlet that passes through the frame and be in fluid communication with an inside of the frame cover. The cable inlet may be configured to enable the cable to pass therethrough. The frame may include a guide wall extending from the barrier and protruding along an inner circumference of the frame cover. The cable inlet may be disposed inside the guide wall. The barrier may include a cable outlet through which the cable passes. The cable outlet may be in fluid communication with an inside of the frame cover. The barrier may extend from a first end to a second end of the frame and include a pair of ribs and a barrier groove defined between the pair of ribs. The door liner may include a liner coupling part that is inserted into the barrier groove and coupled to the barrier. The frame cover may include a pair of cover ribs being connected to the barrier at a position corresponding to a cable outlet. The liner coupling part may be inserted into the barrier groove and the pair of cover ribs. The barrier may include a plurality of reinforcement ribs extending in a protruding direction of the barrier at a bottom surface of the barrier. The outer plate may include a bent plate part extending backward along a circumference of the plate opening. The frame may define a plate accommodating groove at a front surface of the frame. The plate accommodating groove may be recessed along the periphery of the panel assembly and configured to receive the bent plate part. The frame cover may include a cover body accommodating the cable, and a cover edge positioned along a periphery of the cover body and mounted at a rear surface of the frame. The cover edge may pass through the plate accommodating groove. The cover edge may define a recess configured to be coupled to the plate accommodating groove. The panel assembly may include a front panel, a rear panel, and an outer frame. The front panel may at least partially define a front surface of the panel assembly and be configured to shield the plate opening. The rear panel may be spaced apart from the front panel and at least partially define a rear surface of the panel assembly. The rear panel may be configured to shield the liner opening. The outer frame may connect the front panel to the rear panel and at least partially define a lateral surface of the panel assembly. The display may be provided between the front panel and the rear panel. The cable may be connected to the display and extends between the front panel and the outer frame. The panel assembly may include a touch screen disposed at a rear surface of the front panel and configured to sense a touch input at the front panel. The cable may include a touch cable connected to the touch screen. The panel assembly may include a light guide plate disposed behind the display and configured to illuminate the display, and a display light provided at the outer frame and configured to irradiate light onto the light guide plate. The cable may include a light cable connected to the display light. The front panel may have an area that is greater than an area of each of the rear panel and the display. The cable may be disposed along a rear surface of the front panel. The front panel may include a see-through part through which the inside of the panel assembly is visible at a position corresponding to the display, and an opaque bezel disposed at a periphery of the see-through part. The cable may be disposed to pass through the opaque bezel. The frame may include a panel support part extending to an outside of the panel assembly mounting part and configured to support the front panel at a rear side of the panel support part. An cable inlet may be provided at the panel support part. The refrigerator may include an upper cap decoration and a decoration cover. The upper cap decoration may be coupled to an upper end of each of the outer plate and the door liner and define a top surface of the door. The decoration cover may be configured to open and close a decoration opening that is defined at a top surface of the upper cap decoration. The decoration opening may be in fluid communication with the PCB accommodating space. The decoration cover may include a shielding part configured to shield the decoration opening, and a PCB mounting part extending downward from the shielding part and mounting the PCB. Based on the decoration cover being mounted to shield the decoration opening, the PCB may be disposed inside the PCB accommodation space. The cable may include a flexible flat cable. The door may include a main door configured to open and close the storage space and defining a main door opening, and a sub-door configured to open and close the main door opening. The sub-door may include the outer plate, the door liner, the panel assembly, the insulator, and the frame.

In one embodiment, a refrigerator includes: a cabinet in which a storage space is defined; and a door configured to open and close the cabinet, wherein the door includes: an outer plate which defines a front surface of the door and in which a plate opening is defined; a door liner which defines a rear surface of the door and in which a liner opening is defined; a panel assembly configured to shield the plate opening and the liner opening, the panel assembly including a display through which the inside thereof is visible, and a screen is output; an insulator filled in the door; and a frame disposed on a circumference of the panel assembly, wherein the frame includes: a panel assembly mounting part opened so that the panel assembly is mounted; a barrier configured to partition the inside of the door into a PCB accommodating space, in a PCB is disposed, and an insulator accommodating space, in which the insulator is disposed; and a cable guide part which is connected to the panel assembly mounting part and in which a cable configured to connect the panel assembly to the PCB is disposed, wherein a frame cover configured to connect the cable guide part to the barrier in the insulator accommodating space and to guide the cable of the cable guide part into the PCB accommodating space is mounted on the frame.

The cable guide part may be recessed from a front surface of the frame to accommodate the cable.

A cable inlet which passes through the frame to communicate with the inside of the frame cover and through which the cable passes may be provided in the cable guide part.

A guide wall extending from the barrier and protruding along an inner circumference of the frame cover may be disposed on the frame, and the cable inlet may be disposed inside the guide wall.

A cable outlet opened so that the cable passes may be provided in the barrier, and the cable outlet may be configured to communicate with the inside of the frame cover.

A barrier may extend from one end to the other end of the frame and be constituted by a pair of ribs to define a barrier groove between the ribs, and a liner coupling part inserted into the barrier groove so as to be coupled to the barrier may be disposed on the door liner.

A pair of cover ribs connected to the barrier at a position corresponding to the cable outlet may be disposed on the frame cover, and the liner coupling part may be inserted together into the barrier groove and the cover rib.

A plurality of reinforcement ribs extending in a protruding direction of the barrier may be disposed on a bottom surface of the barrier.

A bent plate part bent backward along a circumference of the plate opening may be disposed on the outer plate, and a plate accommodating groove which is recessed along the circumference of the panel assembly and into which the bent plate part is inserted may be defined in a front surface of the frame.

The frame cover may include: a cover body recessed to define a space in which the cable is accommodated; and a cover edge disposed along a circumference of the cover body and mounted on a rear surface of the frame to pass through the plate accommodating groove, wherein a recess that is recessed in a corresponding shape to be coupled to the plate accommodating groove may be defined in the cover edge.

The panel assembly may include: a front panel configured to define a front surface of the panel assembly and shield the plate opening; a rear panel spaced apart from the front panel to define a rear surface of the panel assembly, the rear panel being configured to shield the liner opening; and an outer frame configured to connect the front panel to the rear panel and define a circumferential surface of the panel assembly, wherein the display may be provided between the front panel and the rear panel, and the cable may be connected to the display to pass and extend between the front panel and the outer frame.

The panel assembly may further include a touch screen configured to sense touch of the front panel by a user on a rear surface of the front panel, and the cable may further include a touch cable connected to the touch screen.

The panel assembly may further include: a light guide plate disposed behind the display to illuminate the display; and a display light provided on the outer frame to irradiate light onto the light guide plate, wherein the cable may further include a light cable connected to the display light.

The front panel may have a size greater than that of each of the rear panel and a circumference of the display, and the cable may be disposed along a rear surface of the front panel.

The front panel may include: a see-through part of which the inside is visible at a position corresponding to the display; and an opaque bezel disposed on a circumference of the see-through part, wherein the cable may be disposed to pass through the bezel.

The frame may further include a panel support part extending to the outside of the panel assembly mounting part and configured to support the front panel at a rear side, wherein the cable inlet may be provided in the panel support part.

The refrigerator may further include: an upper cap decoration coupled to an upper end of each of the outer plate and the door liner to define a top surface of the door; and a decoration cover configured to open and close a decoration opening defined in a top surface of the upper cap decoration, wherein the decoration opening may communicate with the PCB accommodating space.

The decoration cover may include: a shielding part configured to shield the decoration opening; and a PCB mounting part which extends downward from the shielding part and on which the PCB is mounted, wherein, when the decoration cover is mounted to shield the decoration opening, the PCB may be disposed inside the PCB accommodation space.

The cable may include a flexible flat cable.

The door may include: a main door which is configured to open and close the storage space and in which an opening is defined; and a sub-door configured to open and close the opening, wherein the sub-door may include the outer plate, the door liner, the panel assembly, the insulator, and the frame.

In another embodiment, a refrigerator includes: a cabinet in which a storage space is defined; and a door configured to open and close the cabinet, wherein the door includes: an outer plate which defines (at least part of) a front surface of the door and in which a plate opening is defined; a door liner which defines (at least part of) a rear surface of the door and in which a liner opening is defined; a panel assembly including a display; an insulator disposed in the door; and a frame disposed on a circumference of the plate opening for supporting the panel assembly, and wherein the frame includes: a panel assembly mounting part on which the panel assembly is mounted, and a barrier separating a PCB accommodating space, in which a PCB is disposed, from a space, in which the insulator is disposed. The frame may further include a cable guide part which is connected to the panel assembly mounting part and in which a cable connecting the panel assembly, in particular to the display and/or a touch screen of the panel assembly, to the PCB is disposed. A frame cover may further be mounted on the frame to connect the cable guide part to the barrier in the insulator accommodating space and to guide the cable of the cable guide part into the PCB accommodating space. Alternatively, a cover sheet may be mounted on the frame to cover a cable extending between the panel assembly and the OCB accommodating space. The panel assembly may be configured to shield the plate opening and the liner opening. The display may be configured such that an inside of the cabinet is visible, and/or a screen, i.e. an image, is output.

In another embodiment, a refrigerator includes: a cabinet in which a storage space is defined; and a door configured to open and close the cabinet, wherein the door comprises: an outer plate which defines (at least part of) a front surface of the door and in which a plate opening is defined; a door liner which defines (at least part of) a rear surface of the door and in which a liner opening is defined; a panel assembly covering the plate opening, the panel assembly comprising a display and/or a touch screen; an insulator in the door; and a frame disposed on a circumference of the plate opening and supporting the panel assembly, and wherein the frame comprises: a barrier separating a PCB accommodating space in the door, in which a PCB is disposed, from an insulator accommodating space in the door, in which the insulator is disposed; a cable inlet formed through the frame, wherein at least one cable extends from the panel assembly through the cable inlet to the PCB for connecting the panel assembly, in particular the touch screen and/or the display, to the PCB; and a frame cover mounted on the frame and extending from the cable inlet to the barrier in the insulator accommodating space for covering the cable. The frame may further include a panel assembly mounting part on which the panel assembly is mounted.

The details of one or more embodiments are set forth in the accompanying drawings and the description below. Other features will be apparent from the description and drawings, and from the claims.

DETAILED DESCRIPTION OF THE EMBODIMENTS

Hereinafter, detailed embodiments will be described in detail with reference to the accompanying drawings. However, the scope of the present disclosure is not limited to proposed embodiments of the present disclosure, and other regressive inventions or other embodiments included in the scope of the present disclosure may be easily proposed through addition, change, deletion, and the like of other elements.

Figure 1:
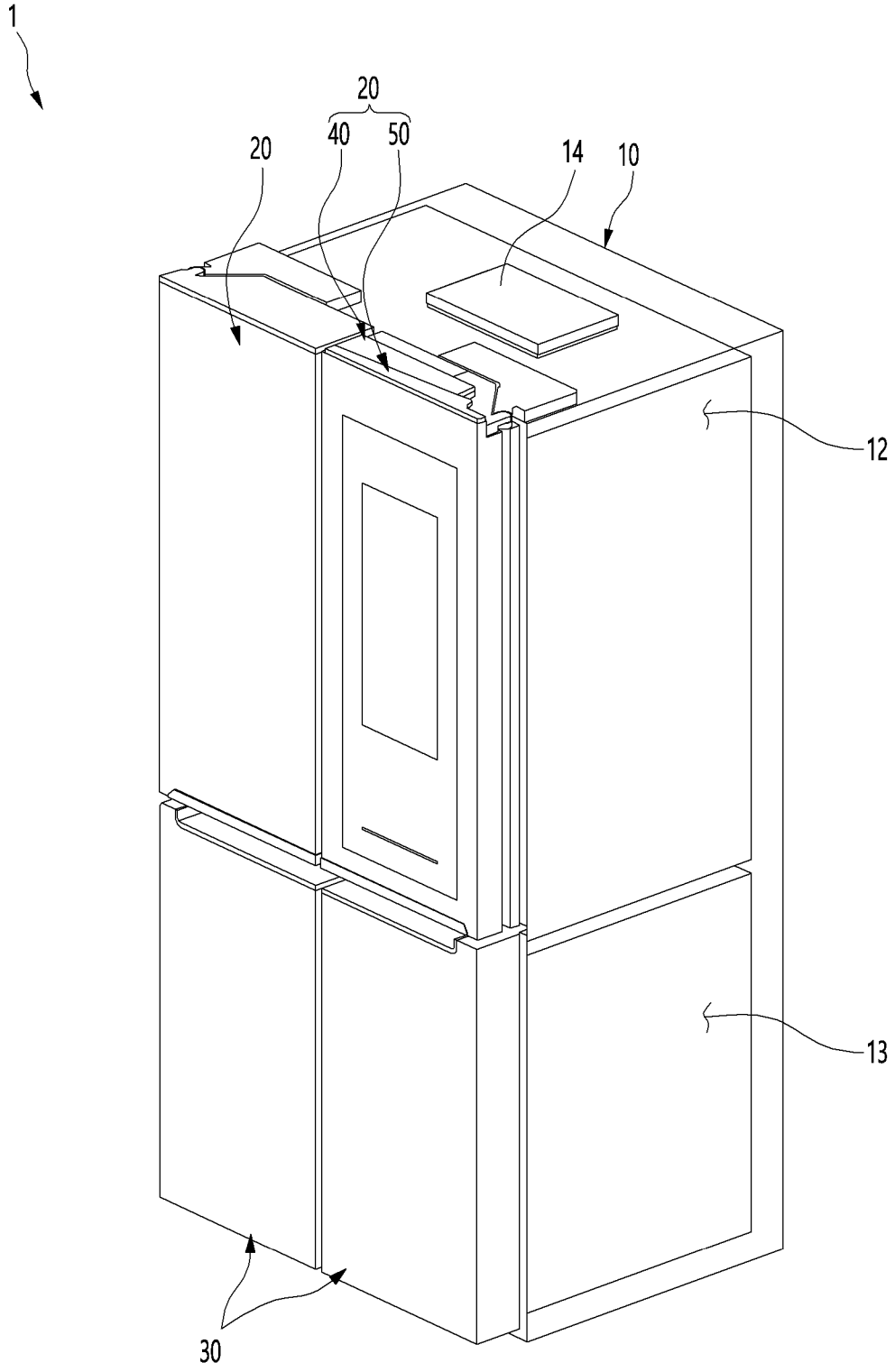
FIG. 1 is a perspective view of a refrigerator according to an embodiment.

FIG. 1 is a perspective view of a refrigerator according to an embodiment.

Figure 2:
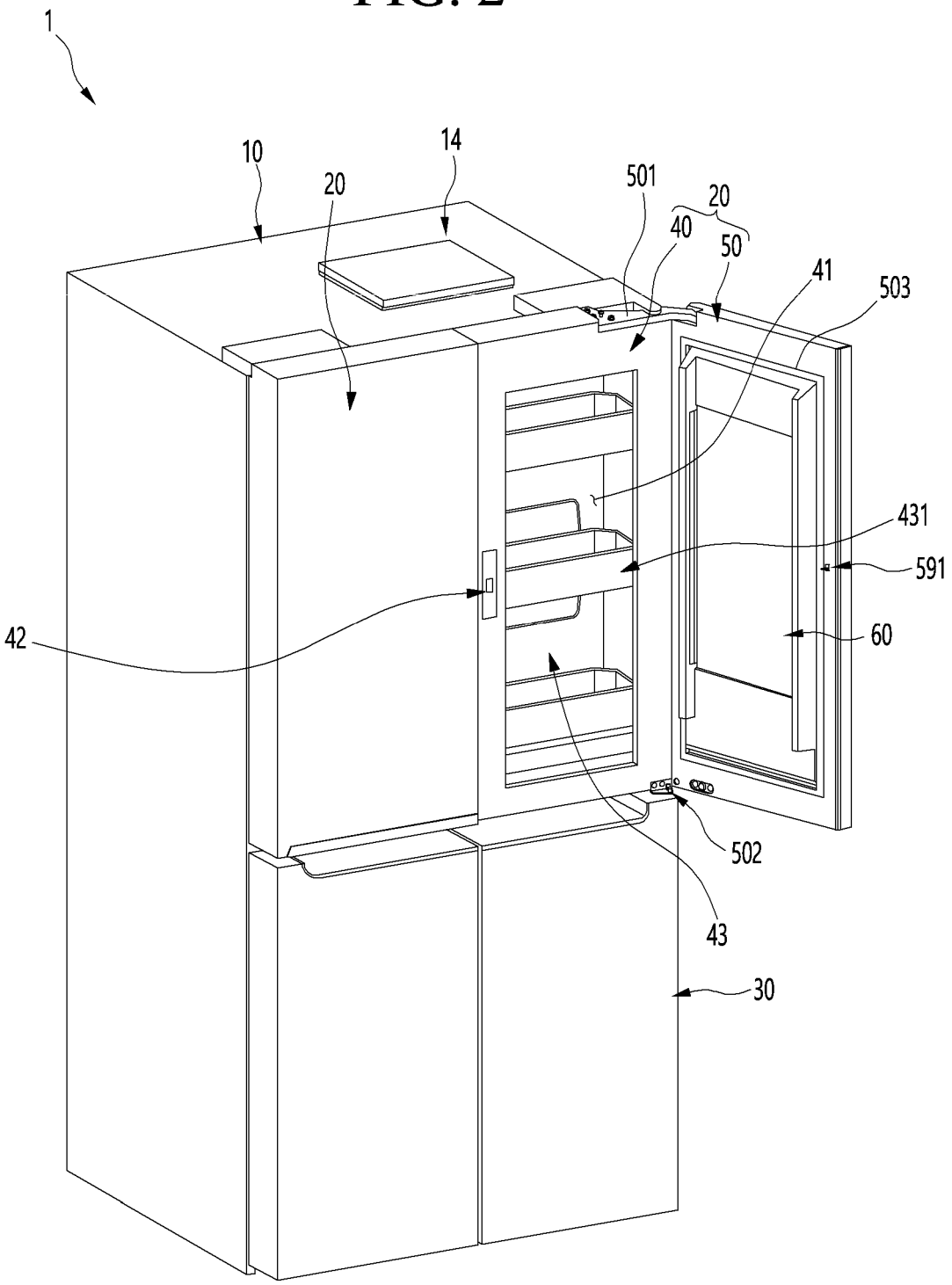
FIG. 2 is a perspective view of the refrigerator with a sub-door opened.

Referring to FIGS. 1 and 2, a refrigerator 1 according to a first embodiment of the present disclosure includes a cabinet 10 defining a storage space and a door that opens or closes the storage space. Here, an outer appearance of the refrigerator 1 may be defined by the cabinet 10 and the door.

Figure 11:
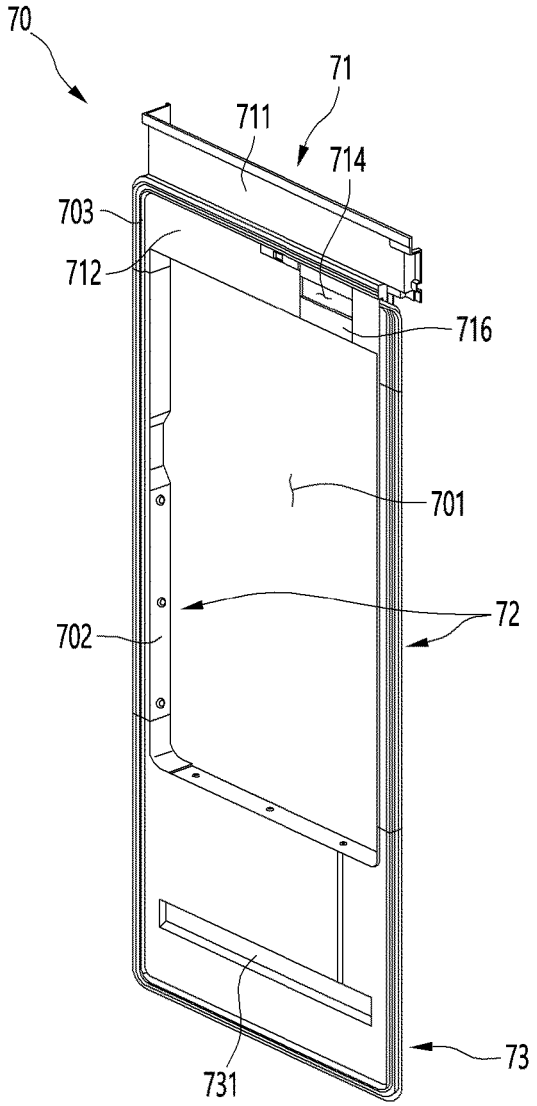
FIG. 11 is a front perspective view of a support frame that is one component of the sub-door.

The inside of the cabinet 10 is partitioned into upper and lower portions by a barrier (see FIG. 11). A refrigerating compartment 12 may be defined in the upper portion of the cabinet 10, and a freezing compartment 13 may be defined in the lower portion of the cabinet 10.

Also, a control unit 14 for controlling an overall operation of the refrigerator 1 may be disposed on a top surface of the cabinet 10. The control unit 14 may be configured to control a cooling operation of the refrigerator as well as electric components for selective viewing and screen output of a see-through part 611.

The door may include a refrigerating compartment door and a freezing compartment door 30. The refrigerating compartment door 20 may be opened and closed by rotating an opened front surface of the refrigerating compartment 12, and the freezing compartment door 30 may be switched by rotating an opened front surface of the freezing compartment 13.

Also, the refrigerating compartment door 20 may be provided in a pair of left and right doors. Thus, the refrigerating compartment 12 is shielded by the pair of doors. The freezing compartment door 30 may be provided in a pair of left and right doors. Thus, the freezing compartment 13 may be opened and closed by the pair of doors. Alternatively, the freezing compartment door 30 may be withdrawable in a draw type as necessary and provided as one or more doors.

Although a refrigerator with a French type door, in which a pair of doors rotate to open and close one space, is applied to a bottom freezer type refrigerator, in which the freezing compartment 13 is provided at a lower portion, is described as an example in this embodiment, the present disclosure may be applied to all types of refrigerators including door without being limited to shapes of the refrigerators.

At least one door may be provided so that the inside of the refrigerator is visible through the door. A see-through part 611 that is an area, through which the storage space in the rear surface of the door and/or the inside of the refrigerator are seen, may be provided in the refrigerating compartment door 20. The see-through part 611 may constitute at least a portion of a front surface of the refrigerating compartment door 20. The see-through part 611 may be selectively transparent or opaque according to user's manipulation. Thus, foods accommodated in the refrigerator may be identified through the see-through part 611.

Also, although the structure in which the see-through part 611 is provided in the refrigerating compartment door 20 is described as an example in this embodiment, the see-through part 611 may be provided in various different types of refrigerator doors such as the freezing compartment door 30 according to a structure and configuration of the refrigerator.

Figure 3:
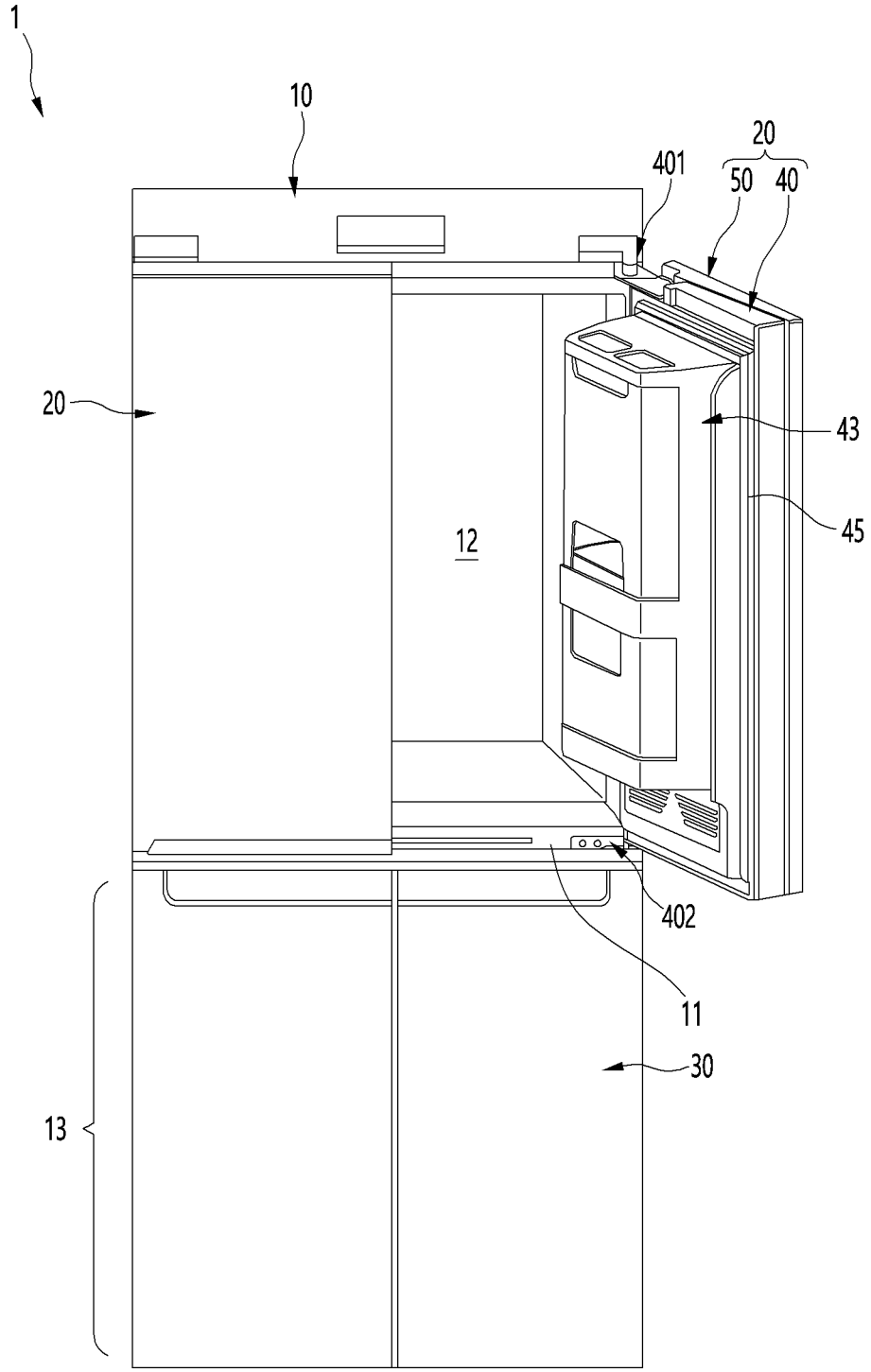
FIG. 3 is a perspective view of the refrigerator with a main door opened.

FIG. 2 is a perspective view of the refrigerator with a sub-door opened. Also, FIG. 3 is a perspective view of the refrigerator with a main door opened.

As illustrated in the drawings, the refrigerating compartment door 20, which is disposed at the right side (when viewed in FIG. 3), of the pair of refrigerating compartment doors 20 may be doubly opened and closed. In detail, the refrigerating compartment door 20, which is disposed at the right side, may include a main door 40 that opening and closing the refrigerating compartment 12 and a sub-door 50 rotatably disposed on a main door 40 to open and close an opening defined in the main door 40.

The main door 40 may have the same size as that of the refrigerating compartment door 20, which is disposed at the left side (when viewed in FIG. 1), of the pair of refrigerating compartment doors 20. The main door 40 may be rotatably mounted on the cabinet 10 by an upper hinge 401 and a lower hinge 402 to open at least a portion of the refrigerating compartment 12.

Also, an opening 41 that is opened with a predetermined size is defined in the main door 40. A door basket 431 may be mounted on the rear surface of the main door 40 as well as the inside of the opening 41. Here, the opening 41 may have a size that occupies most of the front surface of the main door 40 except for a portion of a circumference of the main door 40.

A storage case 43 may be provided on the rear surface of the main door 40. A plurality of door baskets may be disposed in the storage case 43. When the sub-door 50 is opened, the storage case 43 may have a structure that is accessible through the opening 41. Also, the storage case 43 may be provided with a case door to access the inside of the storage case from the rear surface of the main door 40.

Also, a main gasket 45 may be disposed on a circumference of the rear surface of the main door 40 to prevent cool air within an internal space of the cabinet 10 from leaking when the main door 40 is opened. The sub-door 50 may be rotatably mounted on the front surface of the main door 40 to open and close the opening 41. Thus, the sub-door 50 may be opened to expose the opening 41.

The sub-door 50 may have the same size as the main door 40 to cover the entire front surface of the main door 40. Also, when the sub-door 50 is closed, the main door 40 and the sub-door 50 may be coupled to each other to provide the same size and configuration as those of the left refrigerating compartment door 20. Also, a sub gasket 58 may be disposed on the rear surface of the sub-door 50 to seal a gap between the main door 40 and the sub-door 50.

A panel assembly 60 through which the inside of the refrigerator is selectively visible and on which a screen is capable of being output is provided at a center of the sub-door 50. Thus, even though the sub-door 50 is closed, the inside of the opening 41 may be selectively visible, and also an image inside the opening 41 may be output. The see-through part 21 may be a portion of the sub-door 50, through which the inside of the refrigerator 1 is visible. However, the see-through part 21 may not necessarily match the entirety of the panel assembly 60.

The panel assembly 60 may be configured to be selectively transparent or opaque according to user's manipulation. Thus, only when the user desires, the transparent panel assembly 60 may be transparent so that the inside of the refrigerator 1 is visible, otherwise, be maintained in the opaque state. Also, the panel assembly 60 may output a screen or image in the transparent or opaque state.

In the embodiment, the panel assembly 60 is configured to shield an opened portion of the sub-door 50. However, according to types of the door, even when one door is configured as in the right door 20 of the refrigerating compartment 12, an opening may be formed in the door 20, and the transparent panel assembly may be mounted to shield the opening of the door 20. That is, it is noted that the panel assembly 60 may be applied to all types of doors, through which an opening is formed, regardless of the shape of the refrigerator and the shape of the door.

A sub upper hinge 501 and a sub lower hinge 502 may be respectively provided on upper and lower ends of the sub-door 50 so that the sub-door 50 is rotatably mounted on the front surface of the main door 40. Also, a restraint device 591 may be provided on the sub-door 50. A locking unit 42 may be provided on the main door 40 to correspond to the restraint device 591. Thus, the sub-door 50 may be maintained in the closed state by the coupling between the restraint device 591 and the locking unit 42. When the coupling between the opening device 59 and the locking unit 42 is released by manipulation of an opening device 529 provided at a lower end of the door, the sub-door 50 may be opened.

Hereinafter, a structure of the sub-door 50 will be described in more detail with reference to the accompanying drawings.

Figure 4:
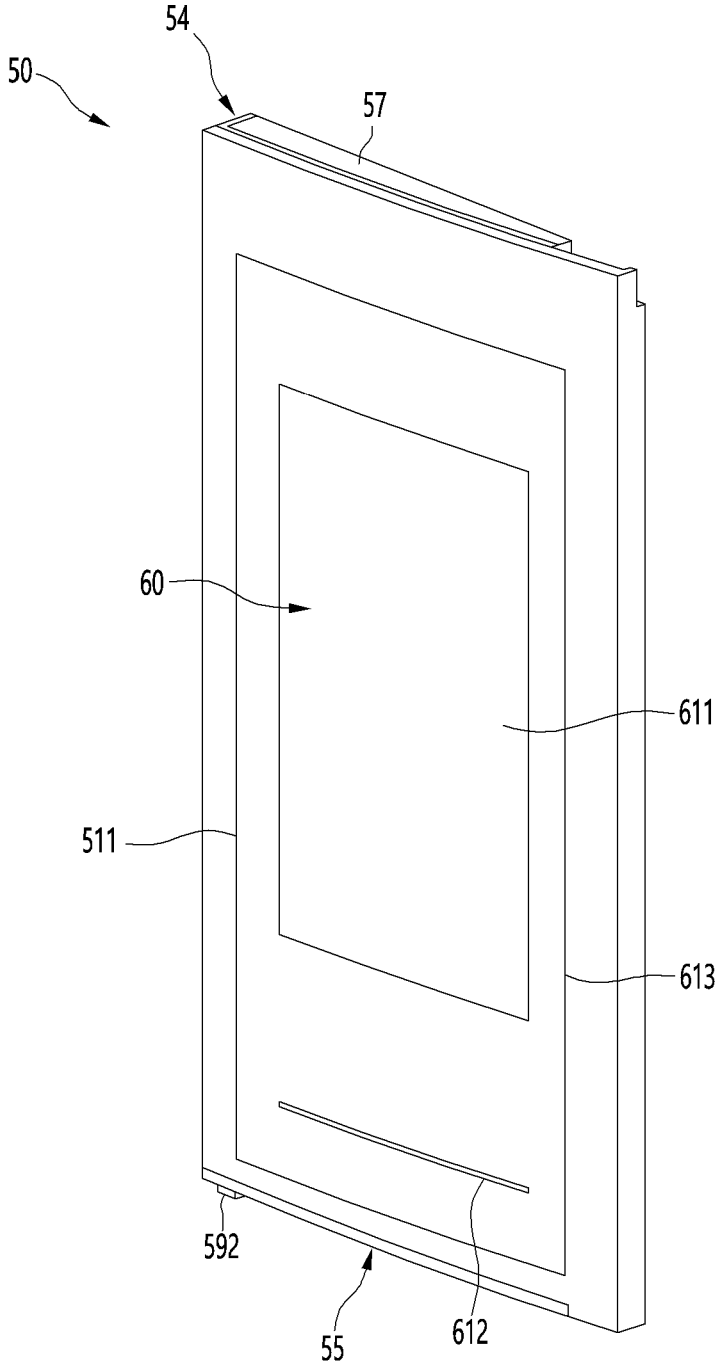
FIG. 4 is a front perspective view of the sub-door.
Figure 5:
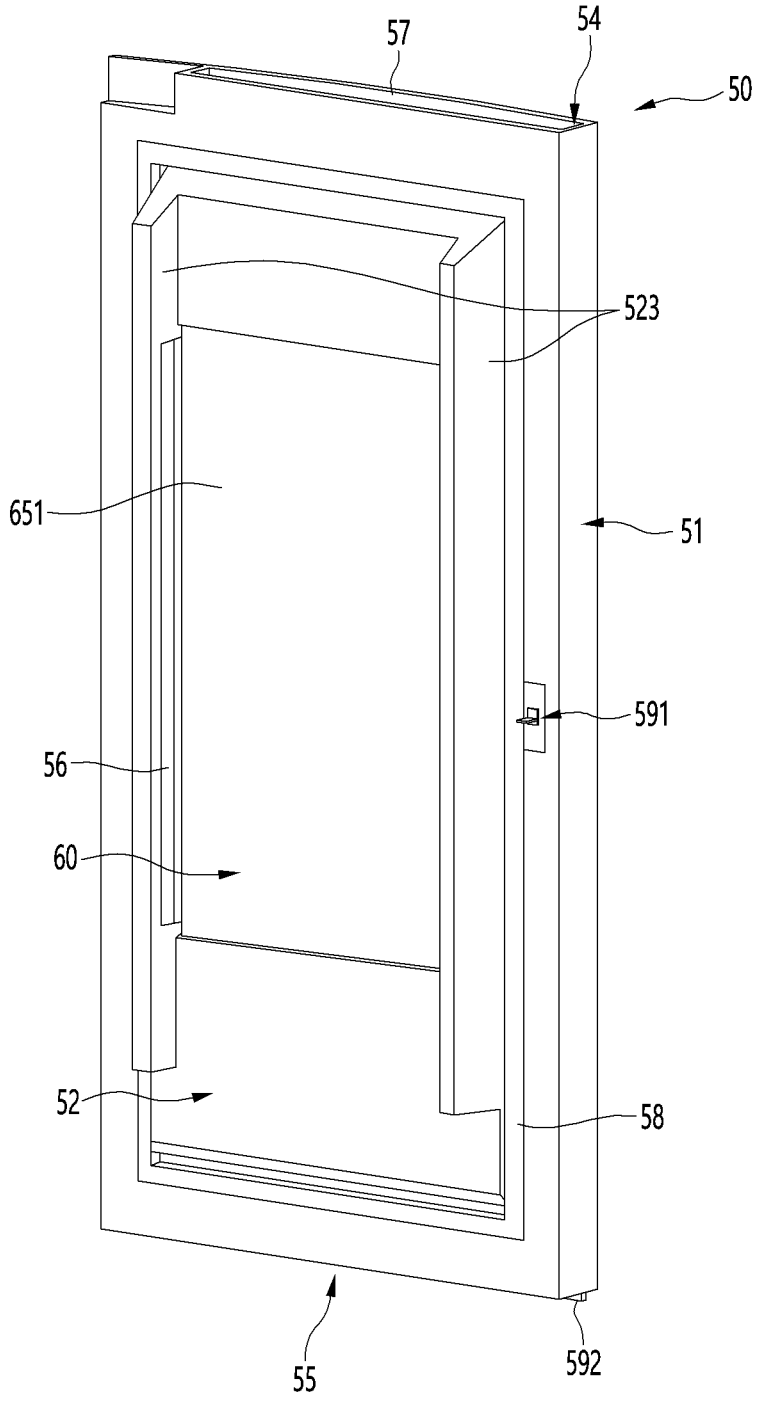
FIG. 5 is a front perspective view of the sub-door.
Figure 6:
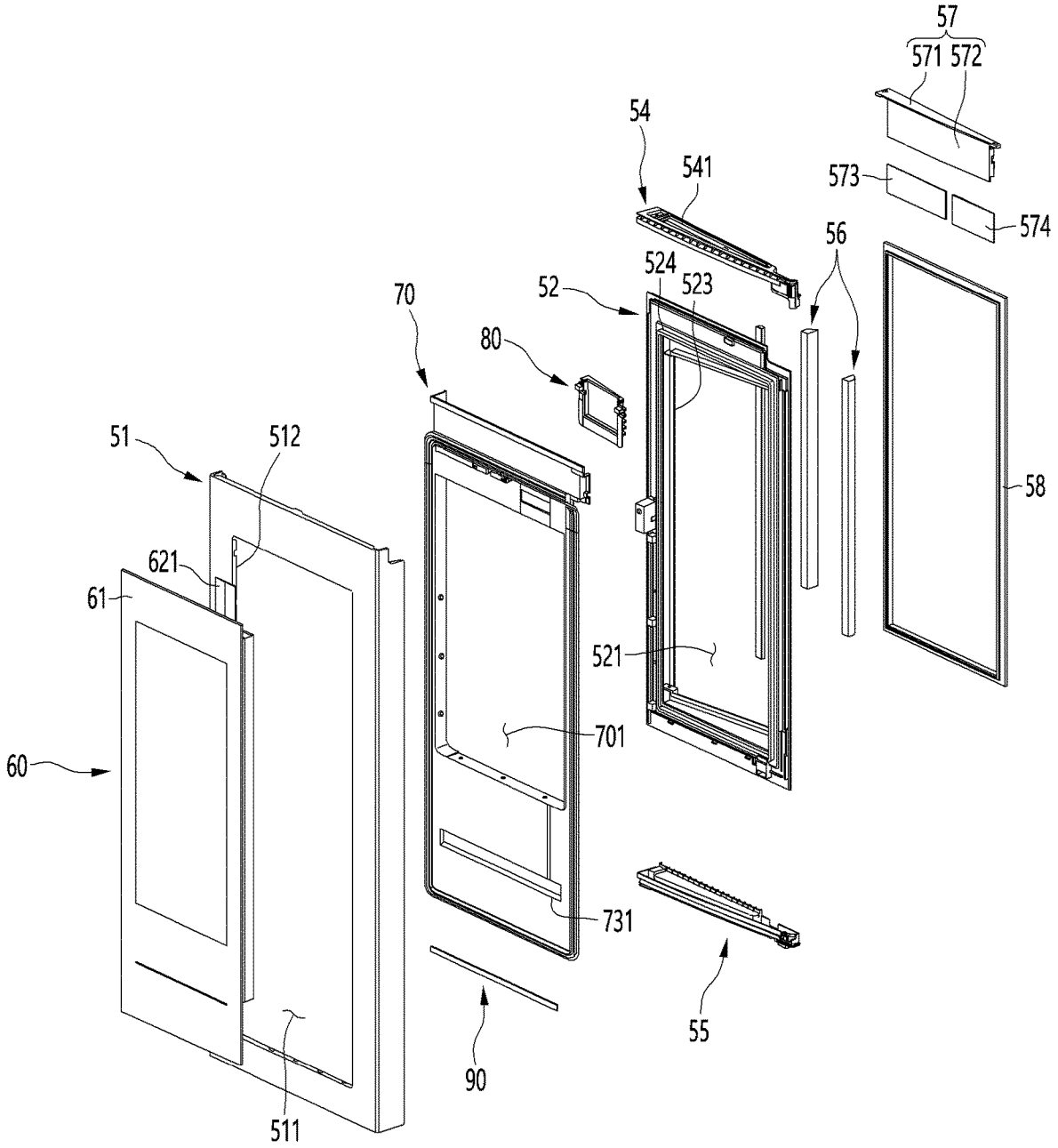
FIG. 6 is an exploded perspective view of the sub-door.

FIG. 4 is a perspective view of the sub-door when viewed from a front side. Also, FIG. 5 is a perspective view of the sub-door when viewed from a rear side. Also, FIG. 6 is an exploded perspective view of the sub-door.

As illustrated in the drawings, the sub-door 50 may include an outer plate 51 defining an outer appearance of the sub-door 50, a door liner 52 mounted to be spaced apart from the outer plate 51, the panel assembly 60 mounted on an opening of the outer plate 51 and the door liner 52, and upper and lower cap decorations 54 and 55 defining the top and bottom surfaces of the sub-door 50. The above-described constituents may be coupled to define the whole outer appearance of the sub-door 50.

The outer plate 51 may constitute an outer appearance of the front surface of the sub-door 50 and a portion of a peripheral surface of the sub-door 50 and be made of a stainless steel material. The outer plate 51 may constitute a portion of the outer appearance of the sub-door 50 as well as the front surface of the sub-door 50. Also, the outer plate 51 may be made of the same material of the front surface of each of the refrigerating compartment door 20 and the freezing compartment door 30. Various surface treatments such as coating or film attachment so as to realize anti-fingerprint coating, hair lines, colors, or patterns may be performed on the front surface of the outer plate 51.

Also, a plate opening 511 may be defined at a center of the outer plate 51. Here, the plate opening 511 may be shielded by the panel assembly 60. Also, since the inside of the refrigerator 1 is visible through the panel assembly 60 that shields the plate opening 511, an internal region of the plate opening 511 may be referred to as the see-through part 611.

A bent plate part 512 that is bent backward may be disposed on a peripheral surface of the plate opening 511. The bent plate part 512 may be disposed along a circumference of the plate opening 511 and extend by a predetermined length so as to be inserted into and fixed to a plate accommodating groove 703 of a frame 70 to be described below.

Both surfaces of the outer plate 51 may be bent to define an outer appearance of a side surface of the sub-door 50. Both ends of the outer plate 51 may be coupled to the door liner 52. Also, upper and lower ends of the outer plate 51 may be coupled to the upper cap decoration 54 and the lower cap decoration 55, respectively. An insulator 53 may be filled inside the outer plate 51, the door liner 52, the upper cap decoration 54, and the lower cap decoration 55.

The door liner 52 defines the rear surface of the sub-door 50 and has a door liner opening 521 in the area on which the panel assembly 60 is disposed. Also, a sub gasket 58 for sealing a gap between the sub-door 50 and the main door 40 may be mounted on the rear surface of the door liner 52.

Also, a door light 56 may be provided on each of both sides of the door liner opening 521. The door light 56 may illuminate the rear surface of the sub-door 50 and a rear side of the panel assembly 60.

Thus, when the door light 56 is turned on, the inside of the storage case 43 may be brightened, and thus, the inside of the refrigerator may be more brightened up than the outside of the refrigerator so that a rear space of the sub-door 50 may be visible through the panel assembly 60.

Also, if the door light 56 is turned on when the panel assembly 60 outputs the screen, the panel assembly 60 may function as an auxiliary backlight to allow the screen to be clearer.

The door light 56 may be mounted on the light mounting part 523 disposed on the rear surface of the sub-door 50. The light mounting part 523 may be disposed on the door liner 52 to protrude rearward along each of both left and right ends of the liner opening 521. Here, the light mounting part 523 may be disposed further behind the panel assembly 60, protrude backward, and pass through the opening 41 in a state in which the sub-door 50 is closed so that the light mounting part 523 is accommodated in the storage case 43. Also, the light mounting parts 523 may be opened in a direction facing each other, and the door lights 56 may be mounted inside the opened sides to irradiate light in the direction facing each other.

The upper cap decoration 54 may define a top surface of the sub-door 50 and be coupled to upper ends of the outer plate 51 and the door liner 52. The top surface of the upper cap decoration 54 is opened so that a decoration opening 541 communicating with an upper space of the panel assembly 60 is formed, and is shielded by a decoration cover 57.

The decoration cover 57 may include a shielding part 571 that shields the decoration opening 541 and a PCB mounting part 572 extending downward from a bottom surface of the shielding part 571. The PCB mounting part 572 may be mounted with PCBs 573 and 574 for an operation the panel assembly 60 and electrical components inside the sub-door 50. The PCBs 573 and 574 may be configured in at least one module form and may be provided in the PCB accommodating space 710 above the sub-door 50.

Here, an inner space of the sub-door 50 except for the PCB accommodating space 710 communicating with the decoration opening 541 may be filled with an insulator 53.

The lower cap decoration 55 may define a bottom surface of the sub-door 50 and be coupled to lower ends of the outer plate 51 and the door liner 52. Also, the lower cap decoration 55 may be provided with a manipulation device 592 that opens the sub-door 50. Also, the lower cap decoration 55 may be further provided with a handle groove that is recessed upward and into which a user's hand is inserted during the rotation operation for the opening of the sub-door 50.

The panel assembly 60 may be disposed between the outer plate 51 and the door liner 52. Also, the panel assembly 60 may be configured to shield the plate opening 511 and the door liner opening 521. Also, the panel assembly 60 may be selectively manipulated to one state of transparent, translucent, opaque, and screen, i.e. image, output states by the user.

Thus, the user may selectively see through the inner space of the sub-door 50 through the panel assembly 60 and see the screen output through the panel assembly 60.

The frame 70 configured to support the panel assembly 60 is mounted on a circumference of the plate opening 511 of the outer plate 51. The panel assembly 60 may be maintained in the fixed and mounted state by the frame 70. Particularly, a front surface of the outer plate 51 and a front surface of the panel assembly 60 may be disposed on the same extension line so that a front surface of the sub-door 50 has a sense of unity, i.e. is smooth or free of steps.

A frame opening 701 is defined at a center of the frame 70. The frame opening 701 has a size somewhat less than that of the plate opening 511 and has a structure in which the panel assembly 60 is seated thereon. In the state in which the panel assembly 60 is mounted on the frame 70, the front surface of the panel assembly 60 may shield the plate opening 511 and be exposed forward. A rear surface of the panel assembly 60 may shield the liner opening 521 and be exposed backward.

Also, the frame 70 may have a coupling structure with the outer plate 51. Here, the outer plate 51 and an end of the panel assembly 60 may be mounted on the inner frame 52 in a state in which the outer plate 51 and the end of the panel assembly 60 are closely attached to each other. Thus, when the sub-door 50 is viewed from the front side, an end of the outer plate 51 and a periphery of the panel assembly 60 are in close contact with each other, so that a gap between the outer plate 51 and the panel assembly 60 is rarely seen or is seen in a form of a line, and the outer appearance of the front surface may be seen as having senses of continuity and unity.

The panel assembly 60 may have a size that is enough to cover the plate opening 511 and the liner opening 561 inside the sub-door 50. Also, the see-through part 611 may be provided in the transparent panel assembly 60 so that the inner space of the refrigerator is selectively visible, and a screen is outputted.

Also, the front surface of the panel assembly 60, which is exposed forward through the outer plate 51, may include the see-through part 611 through which the inside of the panel assembly 60 is visible and on which a screen is output, a bezel 613 provided to be opaque along a circumference of the see-through part 611, and an auxiliary output part 612 through which light is transmitted from a lower side of the see-through part 611.

In detail, the bezel 613 may be disposed on a circumference of a front panel 61 defining the front surface of the panel assembly 60. The bezel 613 may be printed with an opaque color such as black, and components disposed behind the front panel 61 may be covered so as not to be exposed to the outside.

Also, a central area on which the bezel 613 is not disposed may be the see-through part 611, and the see-through part 611 may have a size corresponding to a position corresponding to the display 63. Thus, the see-through part 611 defines an area through which the inside of the refrigerator is visible and defines an area on which the screen is output when the display 63 operates. Thus, the see-through part 611 may be referred to as an output part, a visualization part, and a visualization area.

Also, the auxiliary output part 612, which is narrowed in a vertical direction and extends lengthily in a horizontal direction, may be disposed below the see-through part 611. The auxiliary output part 612 may also be provided to allow light to be transmitted because the bezel 613 is not provided. Thus, information may be displayed, or an operation state of the refrigerator 1 may be displayed by the transmitted light. For example, the see-through part 611 may display a voice recognition state, a touch or note operation input state, an internal temperature, a time setting state, and the like and may be displayed as a partial emission area such as a bar graph. In addition, while the partial emission area moves, the see-through part 611 may be dynamically displayed. Since the auxiliary output part 612 is displayed in the form of a line, the auxiliary output part 612 may be referred to a display.

Hereinafter, a structure of the panel assembly will be described in more detail with reference to the accompanying drawings.

Figure 7:
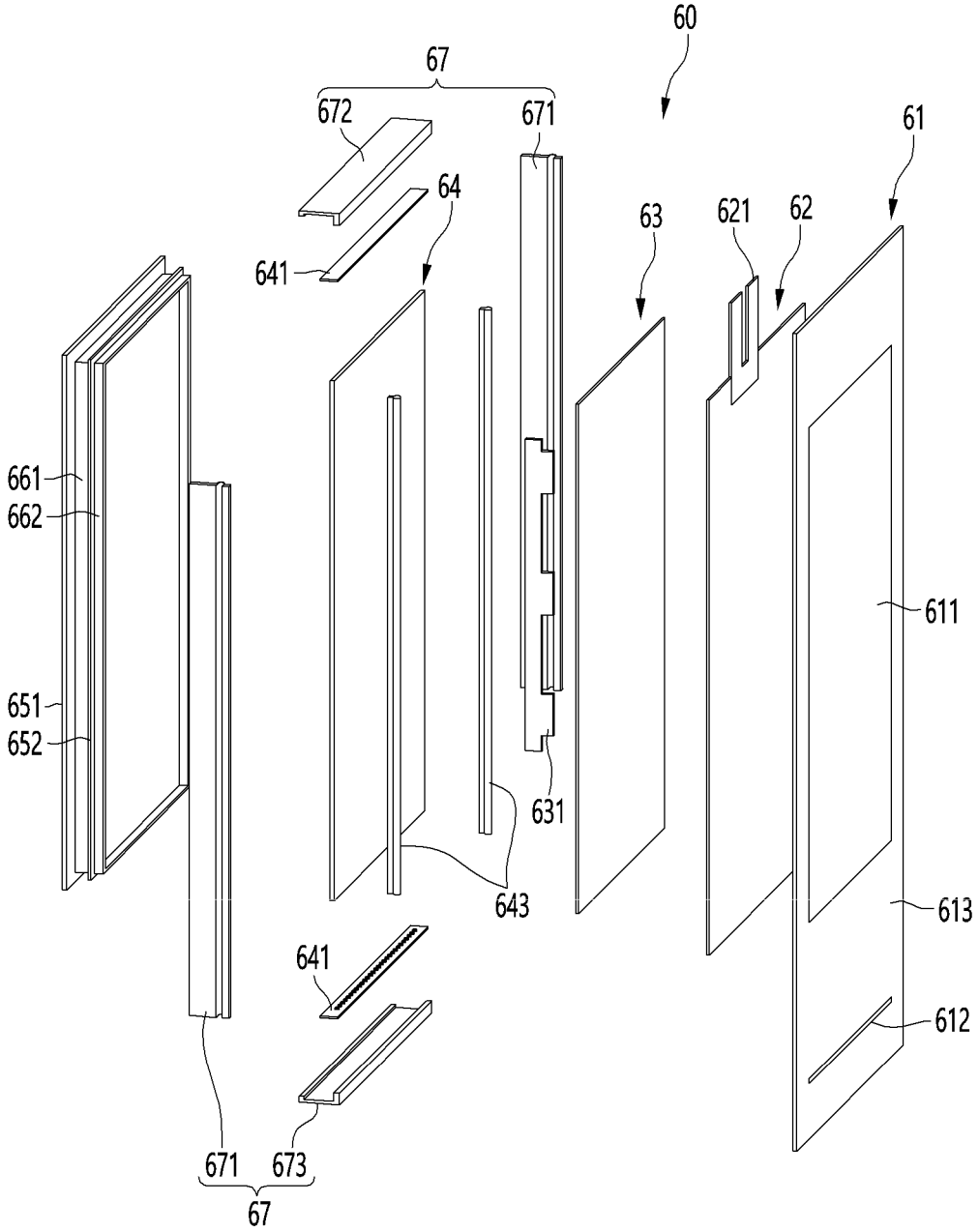
FIG. 7 is an exploded perspective view of a panel assembly that is one component of the sub-door.
Figure 8:
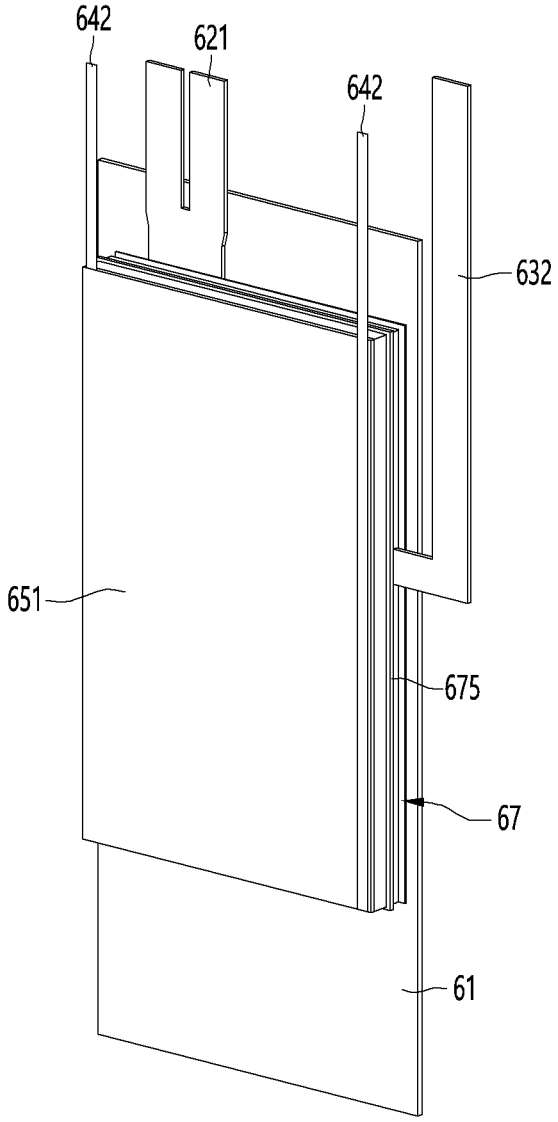
FIG. 8 is a rear perspective view of the panel assembly.
Figure 9:
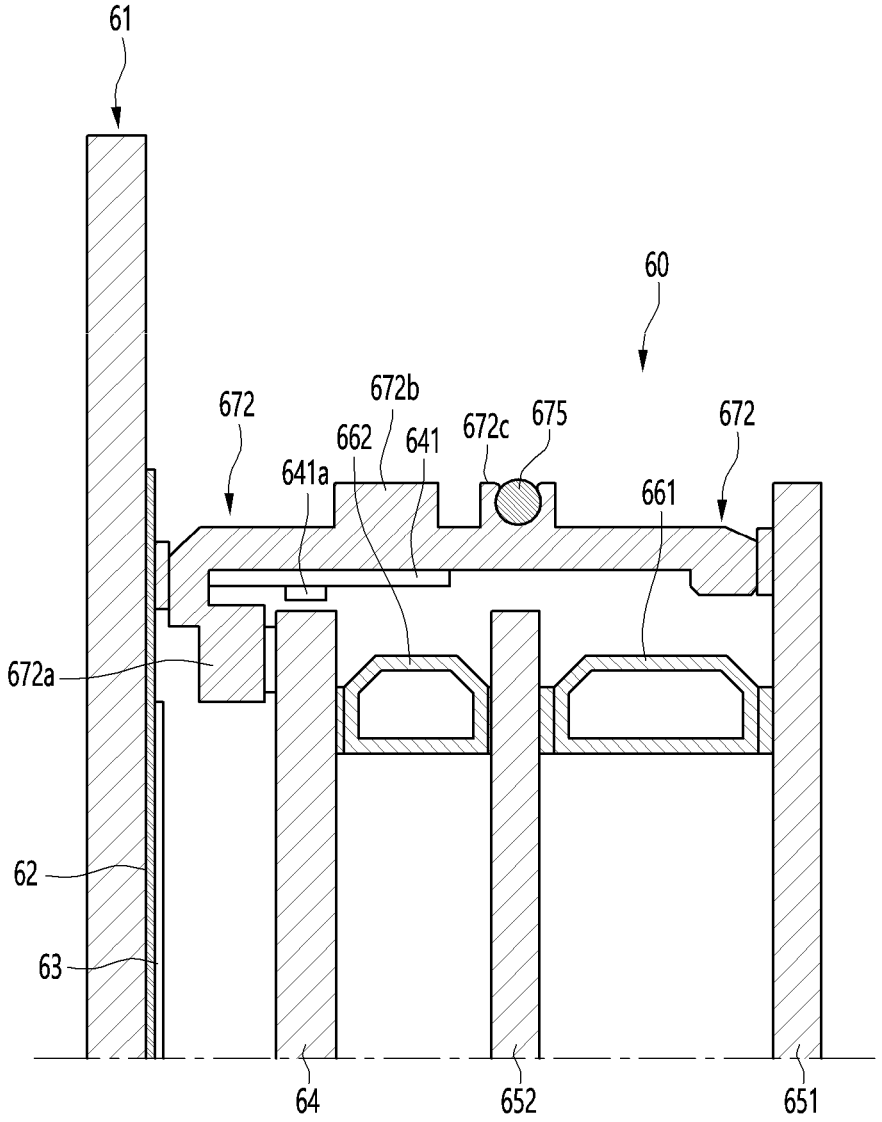
FIG. 9 is a cross-sectional view illustrating an upper end of the panel assembly.
Figure 10:
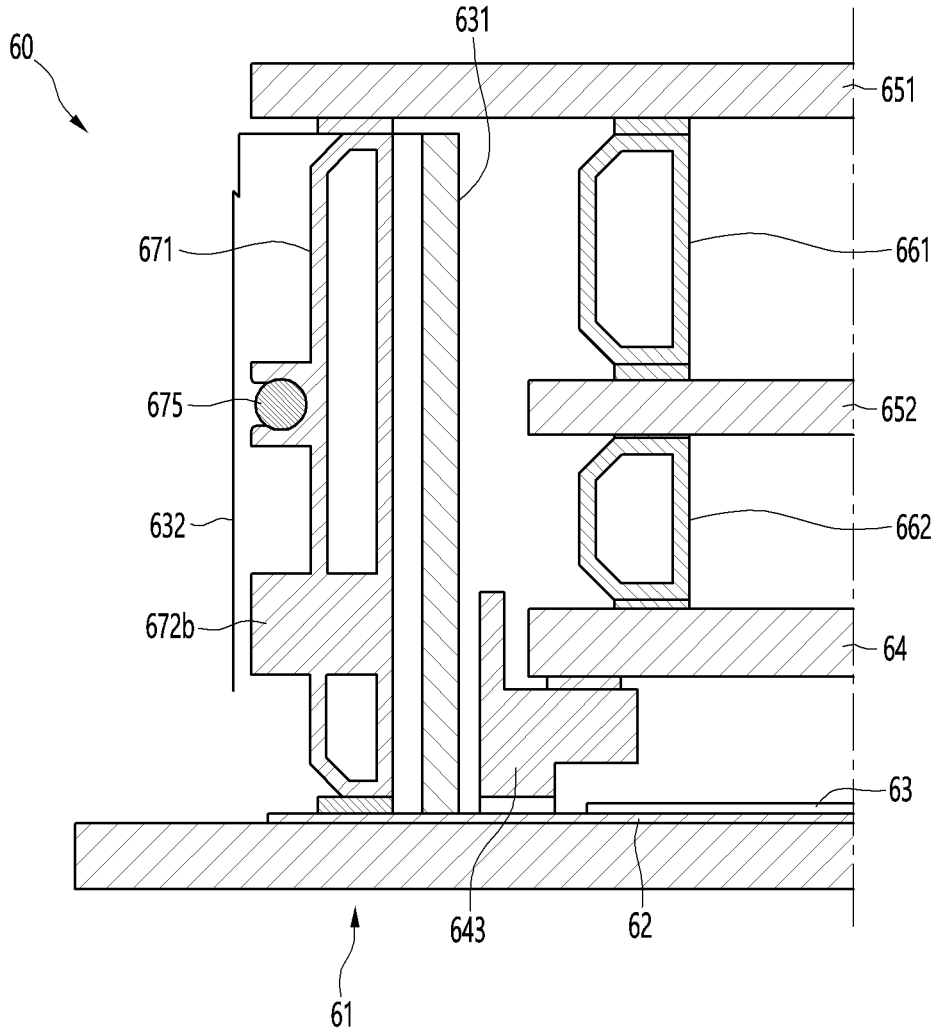
FIG. 10 is a cross-sectional view illustrating one end of the panel assembly.

FIG. 7 is an exploded perspective view of the panel assembly that is one component of the sub-door. Also, FIG. 8 is a rear perspective view of the panel assembly. Also, FIG. 9 is a cross-sectional view illustrating an upper end of the panel assembly. Also, FIG. 10 is a cross-sectional view illustrating one end of the panel assembly.

As shown in the drawings, the panel assembly 60 may be constituted by a plurality of plate-shaped panels, and each of the panels may be spaced a predetermined intervals from each other by at least one spacer to constitute one assembly.

In detail, the panel assembly 60 may have an outer appearance that is defined by the front panel 61 and the rear panel 651, which define the front and rear surfaces of the transparent panel assembly 60, and an outer frame 67 connecting the front panel 61 to the rear panel 651.

The front panel 61 may be made of a transparent material (e.g., blue glass) that defines an outer appearance of the front surface of the panel assembly 60. The front panel 61 may have a size corresponding to that of the plate opening 511 and may have a size greater than that of the frame opening 701. Thus, the rear surface of the front panel 61 may be supported by the frame 70. Also, in a state in which the panel assembly 60 is mounted, an end of the front panel 61 may be in contact with an end of the plate opening 511, and the plate opening 511 and a circumference of the front panel 61 may be in contact with each other.

In detail, the circumference of the front panel 61 may further protrude outward from the rear panel 651, i.e. the front panel 61 may be larger than the rear panel 651 or than the frame opening 701. Thus, the circumference of the front panel 61 defining the front surface of the panel assembly 60 may further extend to the outside of the frame opening 701 and thus may be stably supported by the frame 70. The rear panel 651 as well as the outer frame 67 may be inserted into the frame opening 701.

Also, the frame 70 may be coupled to the panel assembly 60 by coupling the outer frame 67 to a coupling member such as a screw. Thus, the circumference of the panel assembly 60 may be supported by the frame 70, and simultaneously, the frame 70 may be coupled to the outer frame 67 so that the heavy panel assembly 60 is maintained in a stably fixed and mounted state even when the sub-door 50 is opened and closed.

A touch screen bonding (TSB) 62 may be disposed on the rear surface of the front panel 61. The touch screen 62 may have a transparent film shape and be attached to the rear surface of the front panel 61. Thus, even when the area of the see-through part 611 is visualized, or the screen is output on the display 63, the touch screen 62 may not affect the output of the screen. The touch screen 62 may be configured to sense user's touch manipulation and may be referred to as a touch sensing device or a touch sensor.

The touch screen 62 may have a size that is at least equal to or larger than that of the see-through part 611 or the display 63. Thus, when the user touches the area of the see-through part 611, i.e., the screen output area of the front panel 61 of the display 63, the screen output area may be sensed by the touch screen 62, and thus, information may be input and displayed according to the sensed position.

A touch cable 621 connected to the touch sensor 62 may be disposed on an outer end of the front panel 61. The touch cable 621 may connect the touch screen 62 to the PCB 573 above the sub-door 50. That is, the PCB 573 spaced apart from the touch screen 62 and the touch screen 62 may be connected to each other by the touch cable 621.

Also, the touch cable 621 may be provided as a flexible film type cable such as a flexible flat cable (FFC) or a flexible print cable or flexible print circuit board (FPC). A printed circuit may be printed on the touch cable 621 to constitute at least a portion of the PCB 573.

The touch cable 621 may be connected to the touch screen 62 to extend upward. Also, the touch cable 621 may be configured so that a wire is disposed on a base made of a resin material such as a film and may extend upward along the rear surface of the front panel 61. The touch cable 621 may be flexibly bent so that the touch cable 601 has a thin thickness and a wide width like a sheet.

Also, the touch cable 621 may have a shape such as a film or a sheet and thus may have a structure in which an end of the touch cable 621 is easily connected to a connector 573*a* of the PCB 573 when connected to the PCB 573. In addition, the touch cable 621 may be disposed along the rear surface of the front panel 61 and disposed along a wall surface of the inner space of the sub-door 50 to efficiently arrange the space inside the sub-door 50.

In addition, not only the touch cable 621, but also the display cable 632 connected to the display 63 and the light cable 642 connected to the display light 641 may have the same structure. All of the cables 6621, 632, 642, each of which has a flat cable shape as described above, may extend up to an upper end of the panel assembly 60 and may be guided to the PCB accommodating space 710 defined in the upper end of the sub-door 50 having a thin width and wide width. In addition, a simple structure connected to the PCB 573 disposed above the sub-door 50 may be provided.

The display 63 may be disposed on the rear surface of the front panel 61 or on the rear surface of the touch screen. The display 63 may be configured to output a picture or an image through the see-through part 611 and may have a size corresponding to that of the see-through part 611. The display 63 may be provided in the form of a module on which a scree is capable of being output. Also, the display 63 may be transparent so that the user sees the inside through the display 63 when the screen is not outputted. Thus, the display 63 may be referred to as a transparent display and may have various shapes.

A source board 631 may be disposed on one end of both left and right sides of the display 63. The source board 631 may be configured to output a screen through the display 63 and connected to the display 63 and thus provided in an assembled state. Also, a portion of the source board 631 may also have a flexible film type cable structure.

Also, the source board 631 may be disposed inside the outer frame 67. The source board 631 may be disposed inside a side part 671 that defines each of left and right sides of the panel assembly 60 of the outer frame 67. Thus, the source board may be disposed so as not to be exposed through the see-through part.

The source board 631 may be connected to the display cable 632. The display cable 632 may have a flexible and flat structure like the touch cable 621 and also have a structure that is freely bendable.

The display cable 632 may be bent to extend along the circumferential surface of the panel assembly 60, i.e., be bent so that an end thereof extends upward from the transparent panel assembly 60. Thus, the display cable 632 may be coupled to the PCB 573 inside the PCB accommodating space defined in the upper end of the sub-door 50.

A first spacer 643 may be provided on each of both left and right sides of the display 63. The first spacer 643 may allow the display 63 and the light guide plate 64 to be maintained at a set distance. Also, the first spacer 643 may have a rod shape extending from an upper end to a lower end of the display 63 and may be made of aluminum.

The light guide plate 64 may be disposed behind the display 63 and be seated on the first spacer 643 so as to be spaced a predetermined distance from the display 63. The light guide plate 64 is configured so that light irradiated from the display light 641 is diffused or scattered to illuminate the display 63 at the rear side. For this, the light guide plate 64 may have a plate shape having a size equal to or somewhat greater than that of the display 63. The display light 641 may be disposed at a position corresponding to each of upper and lower ends of the light guide plate 64.

The rear panel 651 may be disposed at a rear side of the light guide plate 64. The rear panel 651 may define the rear surface of the panel assembly 60 and have a size greater than that of the light guide plate and less than that of the front panel 61. Also, the rear panel 651 may have a size greater than that of the liner opening 561 to cover the liner opening 561.

A pair of second spacers 661, 661 may be disposed between the rear panel 651 and the light guide plate 64. Each of the second spacers 661 and 662 may have a frame shape, e.g. a polyangular or rectangular frame shape, and be disposed along a circumference of each of an insulation panel 652 and the rear panel 651. Also, the insulation panel 652 may be provided between the pair of second spacer 661 and 662. The insulation panel 652 may be maintained to be spaced a set interval from each of the insulation panel 652 and the rear panel 651 by the pair of second spacers 661 and 662. A double-layered insulating space may be defined by the pair of second spacers 661 and 662, the insulation panel 652, and the rear panel 651.

In detail, the second spacers 662 disposed at the front side may support each of a rear surface of the light guide plate 64 and a rear surface of the insulation panel 652. In this case, the second spacer 662 may simply support the light guide plate 64 so that the light guide plate 64 that is expanded and contracted is effectively supported. In addition, the second spacers 661 disposed at the rear side may support each of a rear surface of the heat insulation panel 652 and a front surface of the rear panel 651. Here, the second spacer 661, the insulation panel 652, and the rear panel 651 may completely adhere to each other. Thus, an insulation space is defined between the rear panel 651 and the insulation panel 652. For example, the insulation space may be defined to be vacuumed or be defined by injecting an insulating gas.

In the state in which the rear panel 651 adheres to the second spacer 66, an outer end of the rear panel 651 may further extend outward from the second spacer 66. Also, the outer frame 67 may be mounted on the outer end of the rear panel 651 so that the rear panel 651 and the front panel 61 are fixed to each other.

The outer frame 67 may have a rectangular frame shape. The outer frame 67 may connect the rear surface of the front panel 61 to the front surface of the rear panel 651 and also define the peripheral surface of the panel assembly 60.

In detail, the outer frame 67 may define a periphery of an outer portion of the panel assembly 60 and also have a connection structure that is capable of allowing the front panel 61 to be maintained at a certain distance. The outer frame 67 may include a pair of side parts 671 defining both left and right surfaces and upper and lower parts, which connect upper and lower ends of the side part 671 to each other and define top and bottom surfaces, respectively.

A space between the front panel 61 and the rear panel 651, i.e., an inner space of the outer frame 37 may be completely sealed by the coupling of the outer frame 67. Also, the inside of the outer frame 67 may be more sealed by a sealant 68 (see FIG. 17) applied a circumference of the outer frame 67.

That is, the overall outer appearance of the panel assembly 60 may be defined by the front panel 61, the rear panel 651, and the outer frame 67, and all of the remaining constituents may be provided in the outer frame 67. Thus, the sealing may be performed only between the outer frame 67, the front panel 61, and the rear panel 651 to completely seal the multilayered panel structure.

The panel assembly 60 may be disposed in the sub-door 50 so that the inside of the refrigerator is seen, and the screen is outputted, and also, the thermal insulation structure may be achieved in the multilayered panel structure at the minimum sealing point to secure the thermal insulation performance.

Also, the display light 641 may be mounted on inner surface of each of the upper part 672 and the lower part 673. The display lights 641 may be mounted on the upper part 672 and the lower part 673, respectively, and the light guide plate 64 may be disposed between the display lights 641.

Thus, light emitted through an LED 641*a* of the display light 641 may be directed to an end of the light guide plate 64 and then travel along the light guide plate 64 so that the entire surface of the light guide plate 64 emits light.

The display lights 641 disposed on the inner upper and lower ends of the panel assembly 60 may be connected to a light cable 642. The light cable 642 may have a flexible and flat shape like the touch cable 621 and the display cable 632.

The light cable 642 may be connected to the display light 641 that is mounted inside the outer frame 67 to extend to the outside of the panel assembly 60.

Also, the light cable 642 may extend along the circumference of the transparent display 63 so that the display light cable 606 is not exposed through the transparent display 63. Also, the light cable 642 may extend upward in a state of being closely attached to the rear surface of the rear panel 651. As occasion demands, the light cable 642 may be bent in the state of adhering to the rear surface of the rear panel 651 and then may be connected to a PCB 573 disposed on the upper portion of the sub-door 50.

Also, the sealant 68 may allow at least one of cables 601, 605, and 606 connected to the touch screen 62, the display panel 63, and the display light 641 within the panel assembly 60 to be accessible therethrough. That is, the sealant 68 may seal a portion that is in contact with an outer surface of each of the cables 621, 632, 642 when the cables 621, 632, 642 extend from the inside to the outside of the panel assembly 60 to prevent water or moisture from being introduced into a space through which the cables 621, 632, 642 are accessible.

A heater 675 may be disposed along an outer surface of the outer frame 67. The heater 675 may have a wire shape and be mounted on a heater mounting part 672*c* recessed along the outer surface of the outer frame 67. Heat generated by the heater 675 may heat the circumference of the front panel 61 along the outer frame 67 to prevent condensation from occurring.

Also, a panel assembly fixing part 672*b* may be disposed on the outer surface of the outer frame 67. A screw passing through the frame 70 may be coupled to the panel assembly fixing part 672*b*. The panel assembly 60 may be maintained in a state of being mounted on the frame 70 by the coupling of the screw.

Hereinafter, the structure of the frame 70 will be described in more detail with reference to the drawings.

Figure 12:
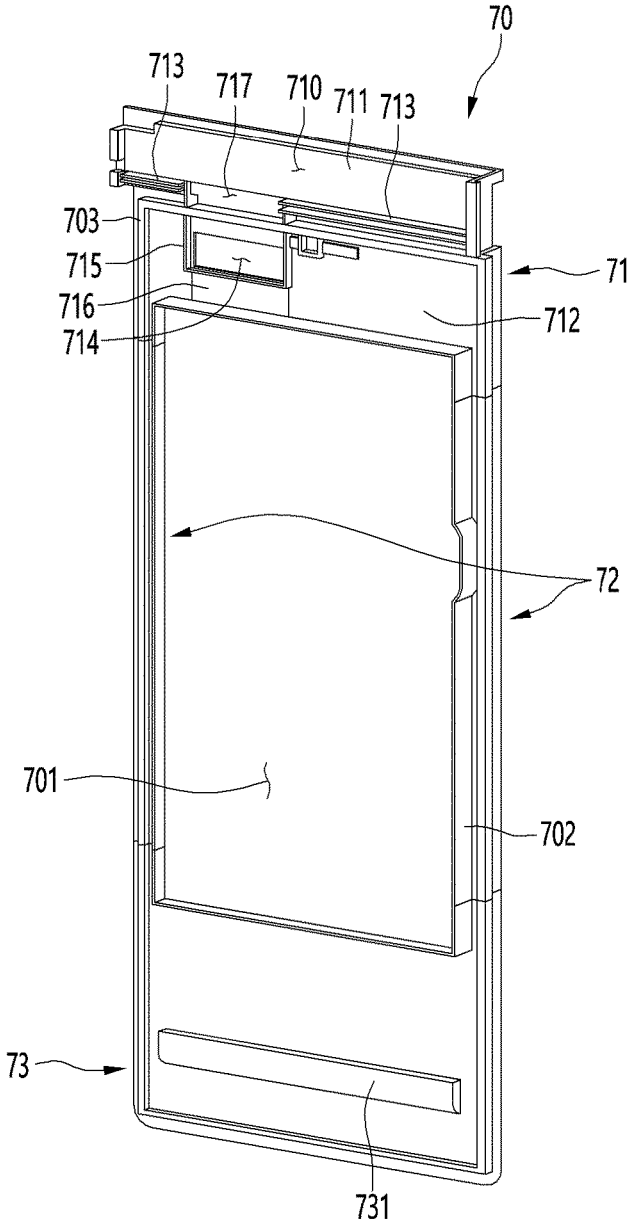
FIG. 12 is a rear perspective view of the support frame that is one component of the sub-door.

FIG. 11 is a front perspective view of a support frame that is one component of the sub-door. Also, FIG. 12 is a rear perspective view of the support frame that is one component of the sub-door.

As illustrated in the drawings, the frame 70 may be injection-molded using a plastic material and may have a rectangular frame shape so that a frame opening 701 is defined at a center thereof. Also, the frame 70 may have a predetermined width and be coupled to the outer plate 51, and simultaneously, the panel assembly 60 may be fixedly mounted on the frame 70.

The frame 70 may include an upper frame 71 defining an upper portion, a lower frame 73 defining a lower portion, and a side frame 72 connecting both ends of each of the upper frame 71 and the lower frame 73 to each other.

In detail, the frame 70 may define the overall shape of the frame 70 having the rectangular frame shape by coupling the upper frame 71, the lower frame 73, and the pair of side frames 72 to each other.

The upper frame 71 may support an upper portion of the outer plate 51 and an upper portion of the front panel 61. The upper frame 71 may define a shape of the upper portion of the frame 70 and may divide the upper space of the sub-door 50 in a front and rear direction. That is, the upper frame 71 may be provided with an upper extension part 711 extending up to the top surface of the sub-door 50, and the space above the sub-door 50 may be divided forward and backward by the upper extension part 711.

Thus, the upper side of the sub-door 50 may be divided forward and backward by the upper frame 71, and a PCB accommodating space 710 in which the PCB 573 is accommodated may be defined in a rear space. The PCB accommodating space 710 may communicate with the decoration opening 541.

The lower frame 73 may be coupled to a lower end of the side frame 72 and may be configured to support a lower portion of the outer plate 51 and a lower portion of the panel assembly 60.

The side frame 72 may define both left and right sides of the frame 70 and extend lengthily in a vertical direction to connect the upper frame 71 to the lower frame 73. That is, the side frame 72 has a structure that is capable of being coupled to both ends of the upper frame 71 and the lower frame 73.

The overall structure of the frame 70 may have the rectangular frame shape by coupling the upper frame 71, the lower frame 73, and the side frame 72 to each other. In a state in which the frame 70 is assembled, a panel assembly mounting part 702 extending backward may be disposed on a circumferential surface of the frame opening 701 defined at the center of the frame 70.

The panel assembly mounting part 702 may extends backward to have a predetermined width and may be disposed to be in contact with the circumferential surface of the panel assembly 60, that is, the outer frame 67. Also, the screw that is coupled to pass through the panel assembly mounting part 702 may be coupled to the outer frame 67 so that the panel assembly 60 is stably fixed and mounted on the frame 70.

Also, a plate accommodating groove 703 recessed along a circumference of the frame 70 may be disposed on a front surface of the frame 70. The plate accommodating groove 703 may be recessed at a position corresponding to the bent plate part 512 so that the bent plate part 512 of the outer plate 51 is inserted and may be disposed along the bent plate part 512. In addition, the bent plate part 512 may be disposed to be in contact with the circumference of the front panel 61 in the state of being inserted into the plate accommodating groove 703.

Inner and outer surfaces of the plate accommodating groove 703 may define a plane having the same height, and thus, the front circumference of the frame 70 may stably support the rear surface of the outer plate 51 corresponding to the circumferential surface of the plate opening 511. That is, each of the upper frame 71, the lower frame 73, and the pair of side frames 72 may support the outer plate 51.

In this embodiment, the frame 70 may have a structure in which the frame 70 is molded to be separated into four parts, but the frame 70 may be provided by coupling two or more components to each other, as necessary.

The lower frame 73 may have a structure that supports and fixes the outer plate 51 and the lower portion of the panel assembly 60, and also, may be provided with a display mounting part 731 on which an auxiliary display 90 that allows light to be irradiated through the auxiliary output part 612 is mounted. For example, the auxiliary display 90 may be configured so that a plurality of LEDs are arranged in a line along a substrate at a position corresponding to the auxiliary output part 612. Thus, the auxiliary display 90 may be referred to as a line display LED bar.

Also, the upper frame 71 may define a space above the sub-door 50 in addition to the structure that supports and fixes the upper portion of the outer plate 51 and the panel assembly 60. In addition, the upper frame 71 may be configured to guide the cable 621 extending from the panel assembly 60.

Hereinafter the structure of the upper frame 71 will be described in more detail with reference to the drawings.

Figure 13:
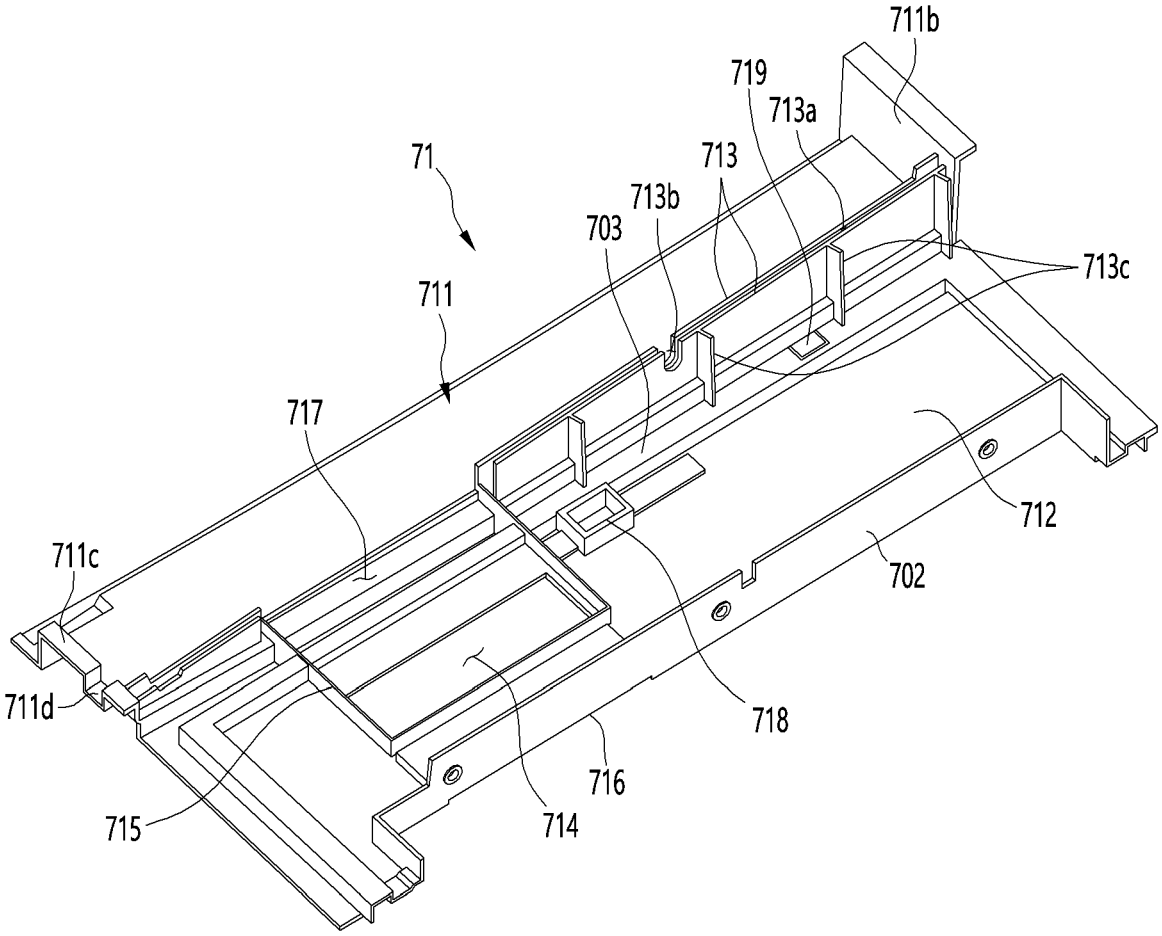
FIG. 13 is a rear perspective view illustrating an upper frame of the support frame.

FIG. 13 is a rear perspective view illustrating the upper frame of the support frame.

As illustrated in the drawings, the upper frame 71 may include a barrier 713 disposed between the upper end extension part 711 and the lower panel support part 712 and between the upper extension part 711 and the panel support part 712.

In detail, the frame 70 may be divided into an upper portion and a lower portion based on the barrier 713. The panel support part 712 may have a structure coupled to the outer plate 51 and the upper end of the panel assembly 60. Also, the upper extension part 711 defines the PCB accommodating space 710, in which the PCB 573 is disposed, in the upper end of the sub-door 50. Also, the barrier 713 may divide the panel support part 712 and the upper extension part 711 and defines a bottom surface of the PCB accommodating space 710 to prevent the insulator 53 filled into the sub-door 50 from being introduced into the PCB accommodating space 710.

In detail with reference to the structure of the panel support part 712, an upper end of the frame opening 701 and a portion of the panel assembly mounting part 702 may be disposed on a lower end of the panel support part 712. Also, both side ends of the bottom surface of the panel support part 712 may be configured to be coupled to the upper end of the side frame 72. In addition, the plate accommodating groove 703 may be defined in the panel support part 712. The plate accommodating groove 703 may be disposed along a circumference of the panel support part 712.

The panel support part 712 may have a structure that allows the cable 621 to be guided from the upper end of the panel assembly 60 to the PCB accommodating space 710.

In detail, a guide wall 715 protruding backward to define a cable accommodating space, into which the insulator 53 is not introduced, may be disposed on the rear surface of the panel support part 712. The guide wall 715 may have a rib shape having a predetermined thickness and may extend downward from the barrier 713.

The guide wall 715 may be disposed to be coupled to the frame cover 80 to be described below and may protrude to a height that is capable of being inserted into the frame cover 80. A lower end of the guide wall 715 may be spaced apart from the panel assembly mounting part 702 and may provide a space in which the frame cover 80 is mounted in the panel support part 712.

The guide wall 715 may include a vertical part extending vertically downward from each of both ends of the cable outlet 717 provided in the barrier 713 and a connection part connecting extending ends of the vertical part to each other. A horizontal width of the guide wall 715 may be greater than that of at least the cable 621 so that the cable 621 passes through the inside of the guide wall 715.

In addition, the guide wall 715 may extend downward from the barrier 713. Here, the guide wall 715 may extend to cross a rear surface of the plate accommodating groove 703. Thus, the frame cover 80 may also be mounted on the portion at which the plate accommodating groove 703 is defined.

A cable inlet 714 may be disposed inside the guide wall 715. The cable inlet 714 may be opened to pass through the panel support 712 inside the guide wall 715. Also, a length of the cable inlet 714 in a horizontal direction may have a size corresponding to the width of the cable 621. Also, the cable inlet 714 may be disposed inside the guide wall 715, i.e., at a lower end of the cable accommodating space. Accordingly, the cable inlet 714 may be prevented from interfering with the plate accommodating groove 703.

A cable guide part 716 extending up to an upper end of the panel assembly 60 may be disposed at a lower end of the cable inlet 714. The cable guide part 716 may be recessed from the front surface of the panel support part 712, and a recessed depth of the cable guide part 716 may correspond to the thickness of the cable 621 or be somewhat greater than the thickness of the cable 621. Thus, even if the front panel 61 is mounted on the frame 70, a passage in which the cable 621 is capable of being disposed may be provided between the front panel 61 and the frame 70 by the cable guide part 716. Thus, in the state in which the sub-door 50 is assembled, the cable 621 extending from a top end of the panel assembly 60 may pass through the cable guide part 716 and may be guided to an inner space of the guide wall 715 through the cable inlet 714.

Also, the cable guide part 716 may be configured to connect the cable inlet 714 to an upper end of the frame opening 701. In addition, the cable guide part 716 may be disposed at a position corresponding to a position at which the cable 621 is disposed on the top end of the panel assembly 60. Also, a width of the cable guide part 716 may correspond to a horizontal width of the cable 621 or be somewhat larger than the horizontal width of the cable 621. Also, the width of the cable guide part 716 may correspond to a horizontal width of the inner space defined by the guide wall 715.

In addition, a microphone mounting part 718 on which a microphone (not shown) that receives a user's voice signal may be disposed at a center of an upper portion of the panel support part 712. In addition, a ground hole 719 through which a wire for grounding is connected may be defined in an upper portion of the panel support part 712 by opening a portion of the plate accommodating groove 703. The wire for the grounding may be connected to a portion of the bent plate part 512 protruding through the ground hole 719.

The microphone and the wire for the grounding may have to be accessible to the inside of the PCB accommodating space 710 and may pass through a wire groove 713*b* defined in the barrier 713. For this, the wire groove 713*b* may be defined in the barrier 713 between the microphone mounting part 718 and the ground hole 719.

The cable accommodating space 810 defined by the guide wall 715 may be opened upward, and the opened top surface of the cable accommodating space 810 may be defined by the cable outlet 717. The cable outlet 717 may provide an inlet configured to so that the cable 621 is inserted into the space formed by the guide wall 715 is guided to the PCB accommodating space 710 and may be provided by cutting a portion of the barrier 713. Also, the cable outlet 717 may be referred to as a barrier opening because the cable 621 passes through the barrier 713 and is guided to the outside of the cable accommodating space 810.

The barrier 713 may cross the upper frame 71 in the horizontal direction. Also, the barrier 713 may protrude vertically from a rear surface of the upper frame 71.

The sub-door 50 may have a thickness that gradually increase from one end, to which a rotation axis of the sub hinge is coupled, to the other end thereof. Thus, the barrier 713 may have a protruding height that gradually increases as it extends from one end to the other end to correspond to the thickness of the sub-door 50.

The barrier 713 may have the form of a pair of plates spaced apart from each other in the vertical direction. Thus, a barrier coupling groove 713*a* may be defined by the barrier 713. The barrier coupling groove 713*a* may be provided so that a liner coupling part 524 protruding from the front surface of the door liner 52 is inserted. Thus, when the door liner 52 is assembled, the liner coupling part 524 protruding in a rib shape at a position corresponding to the barrier coupling groove 713*a* may be inserted into the barrier coupling groove 713*a*. The inside of the sub-door 50 may be divided vertically with respect to the barrier 713 by the coupling of the door liner 52, and a foam liquid filled in the sub-door 50 may not be introduced above the barrier 713, i.e., into the PCB accommodating space 710.

A barrier reinforcement rib 713*c* may be disposed on the lower barrier 713 of the pair of barriers 713. The barrier reinforcement rib 713*c* may extend from the rear surface of the frame 70 in the protruding direction of the barrier 713. Here, the barrier reinforcement rib 713*c* may extend up to an end of the barrier 713. Also, the barrier 713 may protrude downward by a predetermined height with respect to a bottom surface of the barrier 713. When a plurality of the barrier reinforcement ribs 713*c* are provided at regular intervals, and the foam liquid is injected to form the insulator 53, the barrier 713 may be prevented from being deformed or damaged by an injection pressure of the foam liquid.

The cable outlet 717 may be disposed in the barrier 713. The cable outlet 717 may pass through the barrier 713 vertically to communicate with a top surface of the cable accommodating space 810. That is, the cable outlet 717 may be provided to be opened by cutting a portion of the barrier 713. Also, the barrier 713 may extend at each of both left and right ends with respect to the cable outlet 717.

The upper extension part 711 may extends upward from the upper end of the barrier 713 to extend up to the top surface of the sub-door 50, that is, a bottom surface of the upper cap decoration 54. The upper extension part 711 may extend upward to define the PCB accommodating space 710. Also, side portions 711*b* and 711*c* defining both left and right surfaces of the PCB accommodating space 710 may be further disposed on both left and right sides of the upper extension part 711. A side hole 711*d* may be defined in each of the side portions 711*c*, which is adjacent to the rotation axis of the sub-door 50, of the left and right side portions 711*b* and 711*c*. The side hole 711*d* may allow the wire cable connected to the PCB 573 to be guided to the outside of the sub-door 50 through the rotation axis of the sub hinge.

The upper extension part 711 may be spaced apart from a front surface of the outer plate 51, and the molded insulator 531 may be disposed in a space between the outer plate 51 and the upper extension part 711. The molded insulator 531 may be made of an insulation material. For example, the molded insulator 531 may be provided as a vacuum insulator having excellent insulating performance or may be made of the same material as the insulator 53.

Also, the molded insulator 531 may be molded with a size and shape corresponding to a size of the space between the outer plate 51 and the upper extension part 711. Thus, in the process of assembling the sub-door 50, the molded insulator 531 may be inserted and mounted between the outer plate 51 and the front surface of the upper extension part 711. Even if the PCB accommodating space 710 is defined in the top of the sub-door 50 by mounting the molded insulator 531, and the insulator 53 is not filled in the PCB accommodating space 710, dew condensation may be prevented from being generated on the front surface of the outer plate 51.

Hereinafter, the frame cover 80 will be described in more detail with reference to the drawing.

Figure 14:
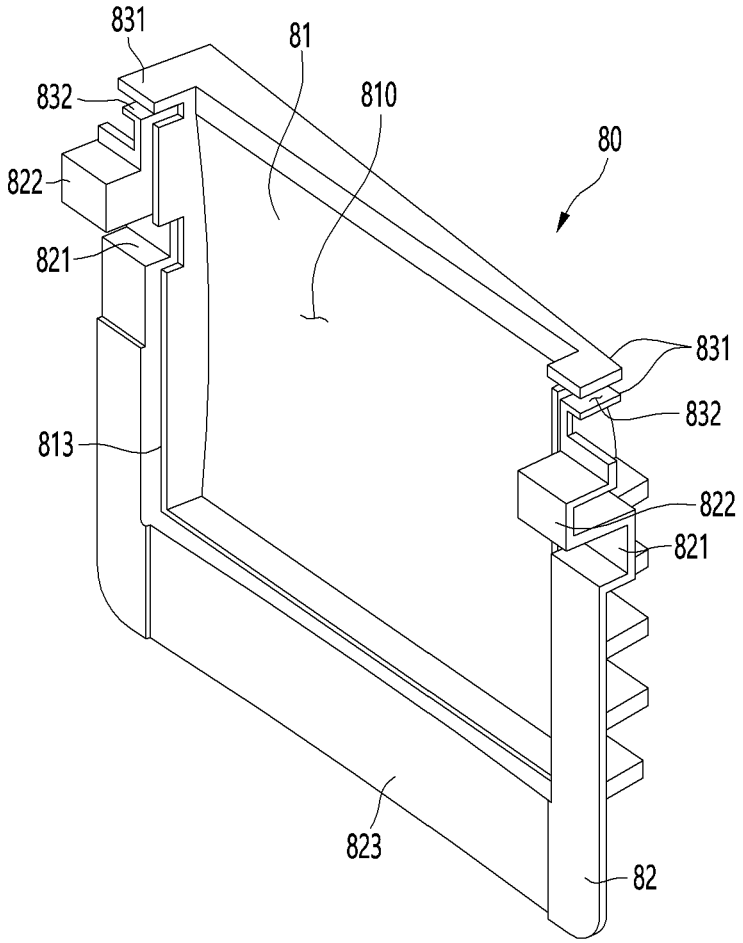
FIG. 14 is a front perspective view of a frame cover that is one component of the sub-door.
Figure 15:
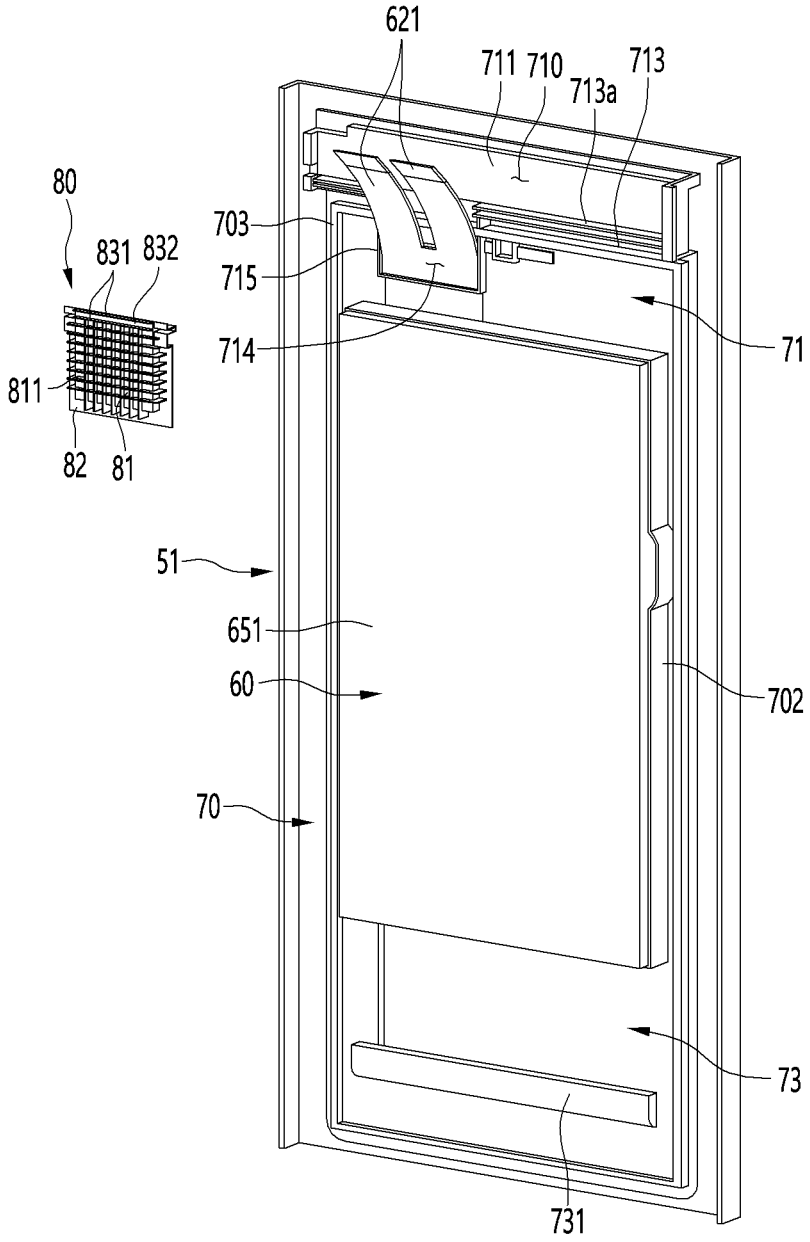
FIG. 15 is a view illustrating a state in which an inner cover is separated from the support frame.

FIG. 14 is a front perspective view of the frame cover that is one component of the sub-door. Also, FIG. 15 is a view illustrating a state in which the inner cover is separated from the support frame.

As illustrated in the drawings, the frame cover 80 may be mounted on an upper portion of the frame 70, i.e., the upper frame 71. Also, the frame cover 80 may separate the inner space of the sub-door 50 into a space in which the cable 621 is disposed and a space in which the insulator 53 is disposed in the state of being mounted on the frame 70.

The frame cover 80 may be coupled to the guide wall 715 to define the cable accommodating space 810. The frame cover 80 may be configured to shield an opened rear surface of the cable accommodating space 810 defined by the guide wall 715.

The frame cover 80 may be coupled to an uneven shape of the upper frame 71 and have a shape in which the cable 621 is capable of being accommodated. Thus, the frame cover 80 may be injection-molded using a plastic material and may be molded in a complex and accurate shape.

The frame cover 80 may include a cover body 81 that shields the guide wall 715 and defines a portion of the cable accommodating space 810. The cover body 81 may be provided in a shape recessed backward, and front and top surfaces of the cover body 81 may be opened. Thus, when coupled to the upper frame 71, the cable accommodating space 810 defined by the upper frame 71 and the frame cover 80 may be opened upward to communicate with the PCB accommodating space 710.

In detail, a guide groove 813 recessed in a shape corresponding to the guide wall 715 may be defined along an inner circumference of the cover body 81. The guide groove 813 may be defined along an outer circumference of the cable accommodating space 810 and have a width corresponding to a thickness of the guide groove 813. Also, the guide groove 813 may be defined along both side surfaces and bottom surfaces of the cable accommodating space 810. Thus, when the frame cover 80 is fixed and mounted to the upper frame 71, the guide wall 715 may be inserted into the guide groove 813.

A rear surface of the cover body 81 is exposed to an inner surface of the sub-door 50, on which the insulator 53 is disposed, and be in contact with the insulator 53. Also, an outer surface of the cover body 81 may define an independent space inside the sub-door 50 so that the insulator 53 is not introduced into the cover body 81.

Also, a cover reinforcement rib 812 may be formed on a rear surface of the cover body 81. The cover reinforcement rib 812 may have a lattice shape and may be disposed over the entire rear surface of the cover body 81. Thus, when the foam liquid is injected into the sub-door 50 to form the insulator 53, the cover body 81 may be prevented from being deformed or damaged by the injection pressure of the foam liquid. Also, the cover body 81 may be provided to withstand the injection pressure of the foam liquid by having a central portion that protrudes slightly backward.

A cover edge 82 may be disposed around the cover body 81. The cover edge 82 may extend outward from the opened front surface of the cover body 81 and may be in close contact with the rear surface of the panel support part 712. An adhesive or an adhesive member may be provided on the cover edge 82 so that the frame cover 80 is firmly attached to the upper frame 71.

The cover edge 82 may be disposed along both left and right surfaces and bottom surfaces of the cover body 81 except for the opened top surface. Also, the cover edge 82 may be completely in close contact with the rear surface of the panel support part 712. In detail, the cover edge 82 on both surfaces of the cover body 81 may pass through the plate accommodating groove 703, and in order to be maintained in close contact with the panel support 712, a recess 821 and a protrusion 822 may be disposed on the cover edge 82.

The recess 821 may be recessed backward at a position corresponding to the plate accommodating groove 703 and also may be recessed in a shape corresponding to that of a rear surface of the plate accommodating groove 703. Therefore, when the frame cover 80 is mounted, the plate accommodating groove 703 may be recessed inside the recess 821 so that the frame cover 80 is maintained in the state of being in close contact with the rear surface of the panel support part 712. Also, the protrusion 822 may be disposed on an upper end of the recess 821 and protrude forward to be inserted into an upper end of the rear surface of the plate accommodating groove 703.

The cover edge 82 may be in close contact with the rear surface of the panel support part 712 by the shape of the protrusion 822 and the recess 821, and thus, the cover body 81 may be mounted to pass through the plate accommodating groove 703. Thus, the cable accommodating space 810 inside the cover body 81 may also be defined over the plate accommodating groove 703, and the cable 621 may extend to the PCB accommodating space 710 without interfering with the plate accommodating groove 703.

Also, a guide part accommodating groove 823 in which the cable guide part 716 is accommodated may be defined in the cover edge 82 below the cover body 81. The guide part accommodating groove 823 may be recessed by a corresponding depth at a position corresponding to the cable guide part 716. Therefore, when the frame cover 80 is mounted, the cover edge 82 may be in close contact with the rear surface of the panel support 712, and the cable guide part 716 may be accommodated in the guide accommodating groove 823.

Also, a pair of cover ribs 831 may be provided on an upper end of the cover body 81. The cover ribs 831 may be disposed along the upper end of the cover body 81 and be spaced apart from each other in the vertical direction. Thus, a cover rib groove 832 may be defined between the pair of cover ribs 831.

Each of the cover ribs 831 may be formed at a position corresponding to the barrier 713, and the barrier 713 may be disposed at both ends of the cover rib 831. That is, an interval between the cover rib grooves 832 may correspond to a vertical width of each of the pair of barriers 713. Thus, when the frame cover 80 is mounted, the barrier 713 may be inserted into the cover rib groove 832.

When the frame cover 80 is mounted, the barrier 713 and the cover rib 831 may be continuously connected to each other. Also, when the door liner 52 is assembled, the liner coupling part 524 protruding from the door liner 52 may be inserted into the barrier coupling groove 713*a* and the cover rib groove 832. Thus, a space under the barrier 713 may be provided with the insulator 53, and the introduction of the foam liquid for molding the insulator 53 into the PCB accommodating space 710 may be blocked.

When the frame cover 80 is mounted, the opened top surface of the frame cover 80 is disposed at a position corresponding to the cable outlet 717 to communicate with the inside of the PCB accommodating space 710. Thus, the cable 621 guided along the inside of the frame cover 80 may be guided to the PCB accommodating space 710 through the frame cover 80.

The cable 621 may extend to the PCB 573 disposed inside the PCB accommodating space 710. Thus, the PCB 573 that is in the state of being mounted on the decoration cover 57 may be inserted into the PCB accommodating space 710 and be connected to the cable 621.

Hereinafter, in the refrigerator 1 having the above-described structure, the arranged state of the cable 621 and the connection structure between the cable 621 and the PCB 573 will be described in more detail with reference to the drawings.

Figure 16:
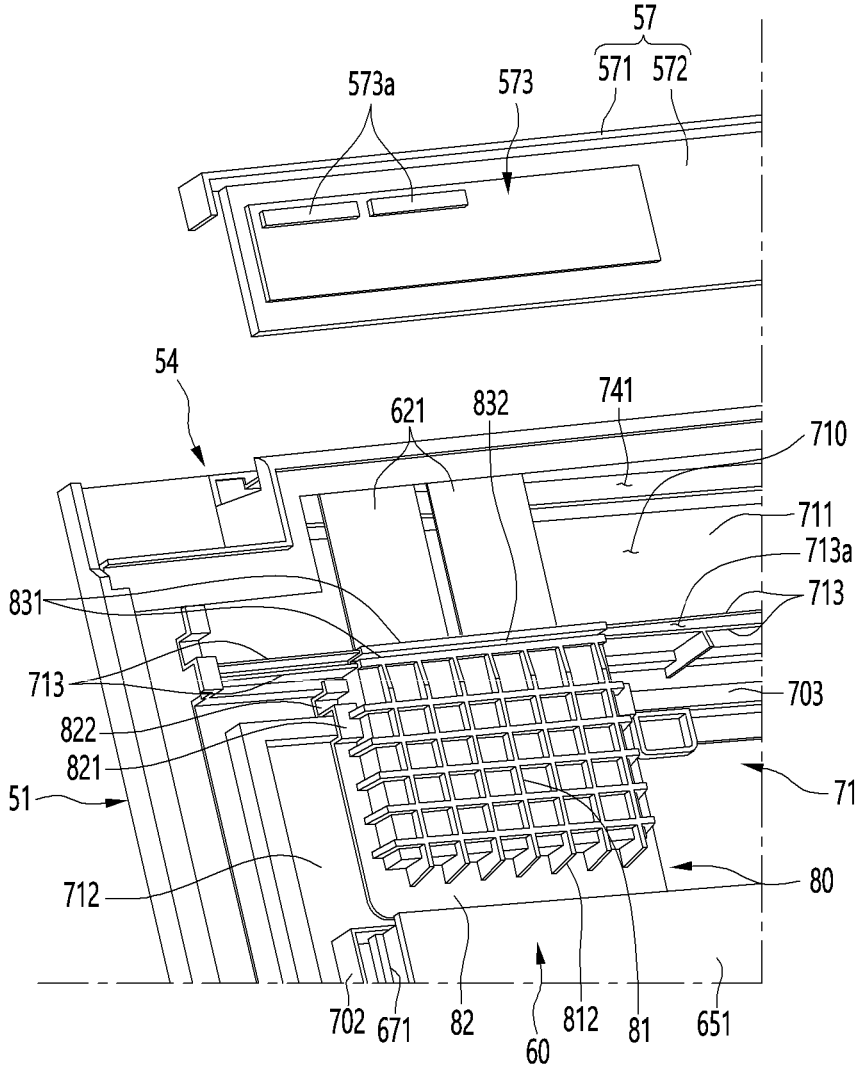
FIG. 16 is a view illustrating an arranged state of the inner cover and a cable.
Figure 17:
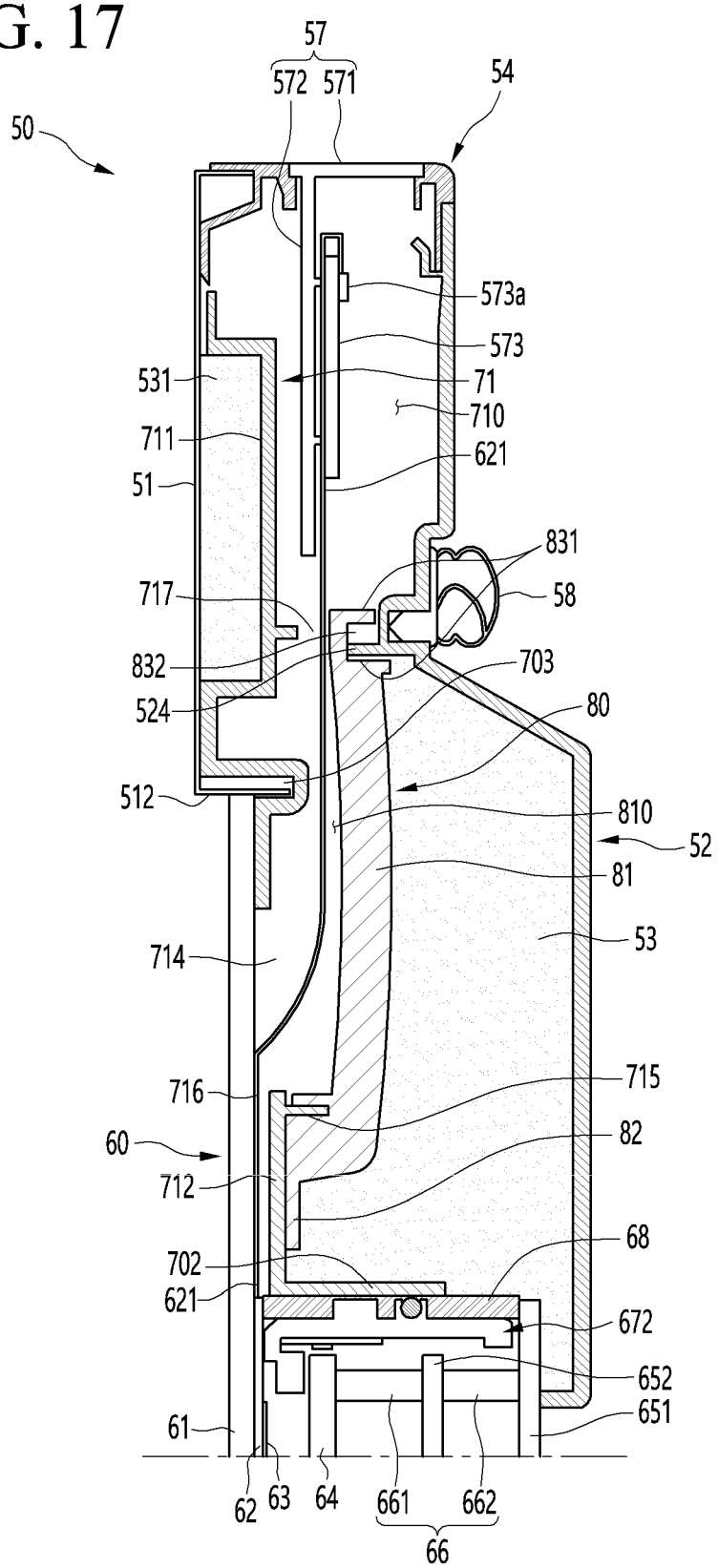
FIG. 17 is a cross-sectional view illustrating a connection state of the cable and a PCB within the sub-door.

FIG. 16 is a view illustrating the arranged state of the inner cover and the cable. Also, FIG. 17 is a cross-sectional view illustrating a connection state of the cable and the PCB within the sub-door.

As illustrated in the drawings, in the state in which the panel assembly 60 and the outer plate 51 are mounted on the frame 70, the door liner 52 and the upper cap decoration 54 may be assembled to define the outer appearance of the sub-door 50.

Also, the foam liquid for molding the insulator 53 may be injected into the inside of the sub-door 50 to fill the inside of the sub-door 50. Here, the insulator 53 may be provided to fill the inside of the sub-door 50 along a circumference of the panel assembly 60.

Particularly, the insulator 53 may be disposed on the upper portion of the sub-door 50 in an outer space except for the cable accommodating space 810 defined by the coupling of the upper frame 71 and the frame cover 80. That is, the insulator 53 may be provided on the upper portion of the sub-door 50 except for the cable accommodating space 810 and the PCB accommodating space 710. Also, the molded insulator 531 may be disposed in a space between the front of the upper extension part 711 and the outer plate 51.

The PCB 573 may be inserted into the PCB accommodating space 710 through the decoration opening 541 while being mounted on the PCB mounting part 572 That is, when the decoration cover 57 is mounted to shield the decoration opening 541, the PCB 573 will be disposed inside the PCB accommodating space 710 while being mounted on the PCB mounting part 572. Here, an additional PCB such as an auxiliary PCB 574 may also be mounted on the PCB mounting part 572.

The cable 621 connected to the touch screen 62 may extend upward along a gap between the front panel 61 and the upper frame 71. That is, the cable 621 may extend upward along the cable guide part 716 disposed on the upper frame 71, and the cable 621 may be introduced into the cable guide space defined by the frame cover 80 through the cable inlet 714. In addition, the cable 621 may be introduced into the PCB accommodating space 710 through the cable outlet 717 extending upward along the guide space of the cable 621.

The cable 621 may have a flexible structure and thus may extend from the cable inlet 714 to the upper portion of the PCB accommodating space 710, in which the PCB 573 is disposed, via the cable outlet 717.

In detail, the cable 621 may extend up to the PCB 573, and the cable may be inserted into the PCB connector 573*a* mounted on the PCB 573. Here, the cable 621 may pass through the space between the PCB mounting part 572 and the PCB 573 to extend upward, thereby preventing an interference with elements mounted on the PCB 573. Also, the cable 621 may be bent above the PCB 573 and connected to the PCB connector 573*a* disposed on the upper portion of the PCB 573.

A length of the cable 621 may be formed to extend to be longer than the upper end of the PCB connector 573*a*. Therefore, even if the decoration cover 57 is separated, and at least a portion of the PCB 573 is drawn out of the decoration opening 741, the cable 621 may be remained in the state of being attached to the PCB connector 573*a*. In the state in which the decoration cover 57 is mounted, and the PCB 573 is inserted into the PCB accommodating space 710, a spare portion of the cable 621 may be accommodated in the cable accommodating space 810. Thus, the PCB 573 may be easily maintained and assembled.

In an embodiment, the structure in which the cable 621 coupled to the touch screen 62 is guided to the PCB accommodating space 710 through the cable accommodating space 810 has been described, but the light cable 642 connected to the display light 641 and the display cable 632 connected to the display 63 may also be guided to the top surface of the panel assembly 60 and then be guided to the PCB accommodating space 710 through the cable accommodating space 810.

In addition to the foregoing embodiment, the refrigerator 1 according to various embodiment may be exemplified.

In another embodiment, a structure in which a cover sheet 89 that protects a cable 621 from an insulator 53 is attached is provided. Another embodiment may be the same as the forgoing embodiment except for only a portion of an upper frame 71 and a structure of a cover sheet 89, and thus, the same constituents will be described using the same reference numerals.

Figure 18:
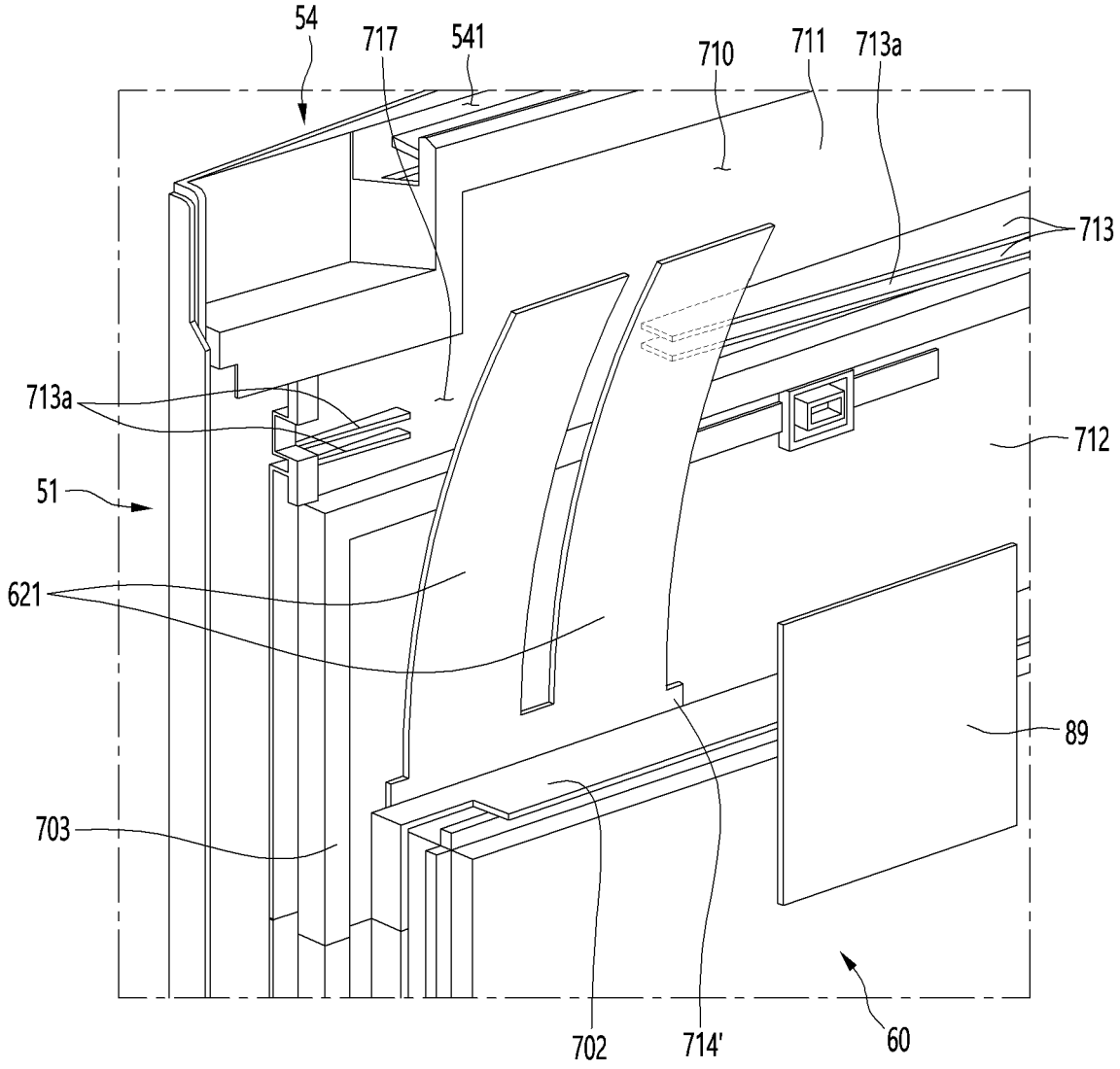
FIG. 18 is an exploded perspective view illustrating an arrangement of a cable and a cover sheet according to another embodiment.
Figure 19:
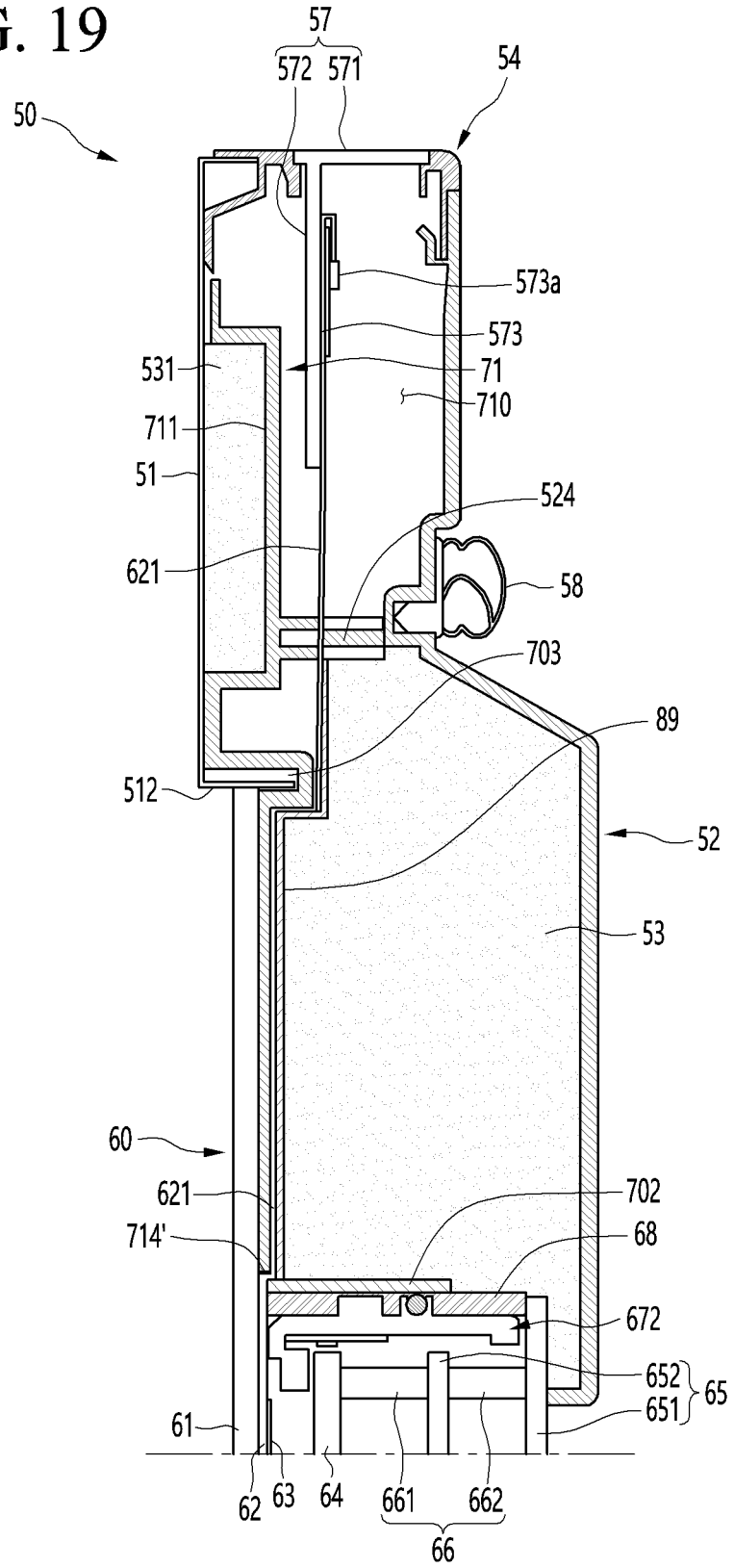
FIG. 19 is a cross-sectional view illustrating a connection state of the cable and a PCB within a sub-door according to another embodiment.

FIG. 18 is an exploded perspective view illustrating an arrangement of a cable and a cover sheet according to another embodiment. Also, FIG. 19 is a cross-sectional view illustrating a connection state of the cable and a PCB within a sub-door according to another embodiment.

As illustrated in the drawing, a sub-door 50 according to another embodiment may include an outer plate 51, a panel assembly 60, a frame 70, an upper cap decoration 54, and a door liner 52, by which an outer appearance of the sub-door 50 is defined.

Also, a PCB accommodating space 710 partitioned by coupling of the frame 70 and the door liner 52 may be defined in an upper end of the sub-door 50. A foam liquid may be injected into the sub-door 50 below the PCB accommodating space 710 to form an insulator 53. In addition, the molded insulator 531 may be provided in front of an upper extension part 711 of the upper frame 71 to thermally insulate a front side of the PCB accommodating space 710.

A decoration opening 541 may be defined in the upper cap decoration 54, and a decoration cover 57 may be mounted to shield the decoration opening 541. Also, a PCB mounting part 572 may be provided on the decoration cover 57 so that a PCB 573 is mounted.

A cable inlet 714' may be provided in the upper frame 71. The cable inlet 714' may be provided at a lower end of the panel support 712. In detail, the cable inlet 714' may be opened at a lower end of the panel support part 712, i.e., at a position that is in contact with the panel assembly mounting part 702. The cable inlet 714' may be provided in the panel assembly mounting part 702.

Thus, the cable 621 extending from a top surface of the panel assembly 60 may extend upward to pass through the cable inlet 714'. The cable 621 may extend upward in the state of being in contact with a rear surface of the upper frame 71 and then pass through a cable outlet 717 provided in a barrier 713 and be inserted into the PCB accommodating space 710.

A size of each of the cable inlet 714' and the cable outlet 717 in a horizontal direction may correspond to a width of the cable 621. Thus, a remaining portion except for the portion through which the cable 621 passes may be configured so as not to be exposed as much as possible.

Also, a cover sheet 89 may be attached to the panel support part 712 on which the cable 621 is disposed. The cover sheet 89 may be configured to be attached to a rear surface of the upper frame 71 by applying an adhesive to one surface thereof. Also, the cover sheet 89 may have a size that is capable of shielding at least a portion of each of the cable inlet 714' including the cable 621 and the cable outlet 717.

Thus, the cover sheet 89 may be attached to the panel support part 712 to shield the cable 621 in a state in which the cable 621 extends to the PCB accommodating space 710. Thus, the cable 621 may be completely shielded by the cover sheet 89. Also, the cable inlet 714' and the cable outlet 717 may be shielded to be prevented from being in contact with the cable 621 when the foam liquid is injected into the sub-door 50.

The cover sheet 89 may have a predetermined thickness, be made of a flexible material, and be effectively attached along a curved portion of a rear surface of the panel support part 712. Also, the adhesive provided on the cover sheet 89 may not be provided on an area on which the cable 621 is disposed, but be provided only around the cover sheet 89 so that the cable 621 and the cover sheet 89 do not substantially adhere to each other.

The foam liquid injected into the sub-door 50 to form the insulator 53 may be provided in a state in which the sub-door 50 is assembled. Particularly, in the state in which the cable 621 is disposed, and the cover sheet 89 is attached, the foam liquid may be injected into the sub-door 50 to protect the cable 621.

When the molding of the insulator 53 is completed, the decoration cover 57 on which the PCB 573 is mounted may be mounted, and simultaneously, an end of the cable 621 may be connected to the PCB connector 573*a*, and then, the PCB 573 may be inserted into the PCB accommodating space 710.

In addition to the foregoing embodiment, the refrigerator 1 according to various embodiment may be exemplified.

In another embodiment, the insulator 53 that is in the molded state may be assembled and mounted on the inside of the sub-door 50 to facilitate the arrangement of the cable 621 and to prevent the cable 621 from being damage. Another embodiment may be the same as the forgoing embodiment except for only a portion of an upper frame 71 and a structure of insulators 532 and 533, and thus, the same constituents will be described using the same reference numerals.

Figure 20:
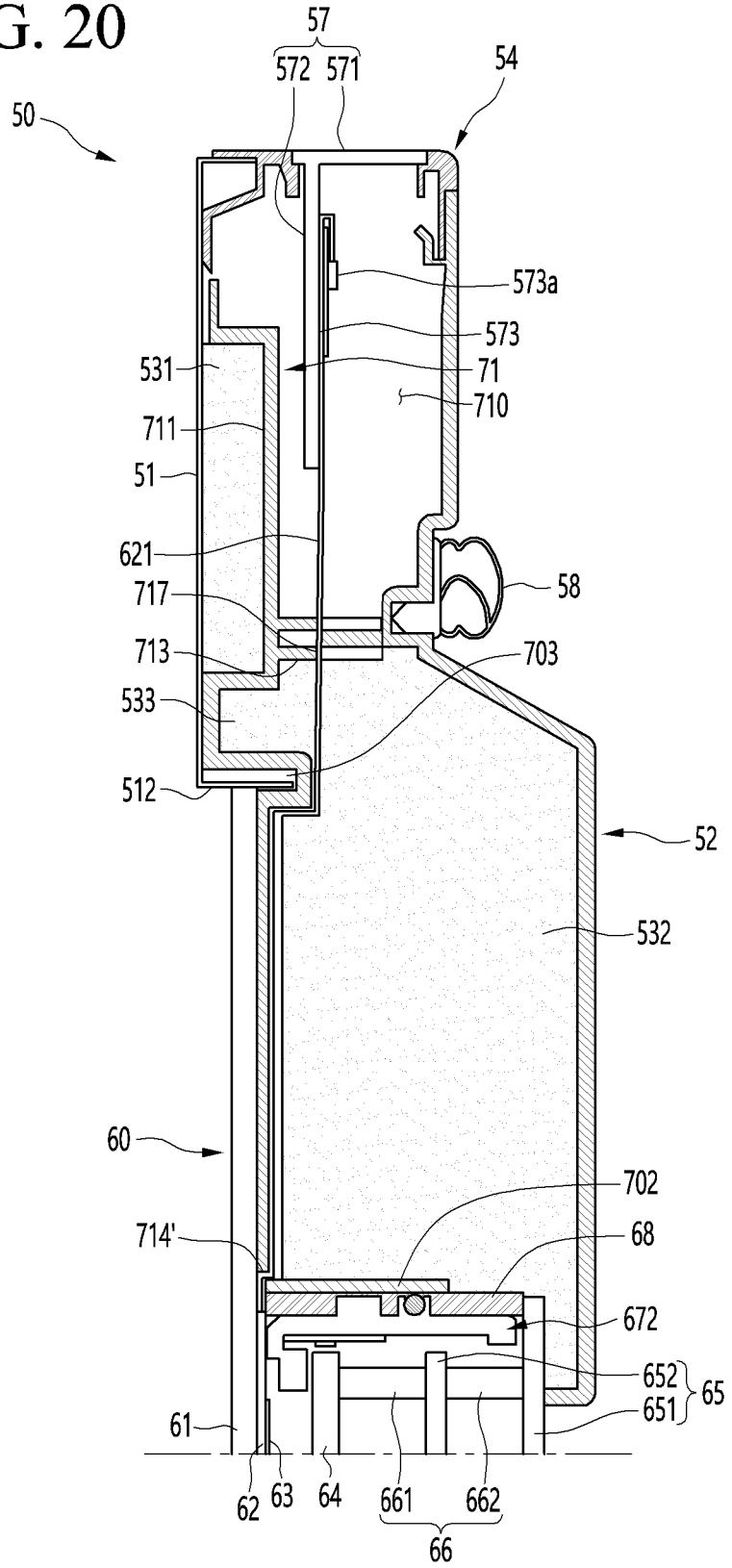
FIG. 20 is a cross-sectional view illustrating a connection state of a cable and a PCB within a sub-door according to further another embodiment.

FIG. 20 is a cross-sectional view illustrating a connection state of a cable and a PCB within a sub-door according to further another embodiment.

As illustrated in the drawing, a sub-door 50 according to another embodiment may include an outer plate 51, a panel assembly 60, a frame 70, an upper cap decoration 54, and a door liner 52, by which an outer appearance of the sub-door 50 is defined.

Also, a PCB accommodating space 710 partitioned by coupling of the frame 70 and the door liner 52 may be defined in an upper end of the sub-door 50. A decoration opening 541 may be defined in an upper cap decoration 54, and the decoration opening 541 may be shielded by mounting a decoration cover 57. Also, a PCB mounting part 572 may be provided on the decoration cover 57 so that a PCB 573 is mounted.

A cable inlet 714' may be provided in the upper frame 71. The cable inlet 714' may be provided at a lower end of the panel support 712. In detail, the cable inlet 714' may be opened at a lower end of the panel support part 712, i.e., at a position that is in contact with the panel assembly mounting part 702.

Thus, the cable 621 extending from a top surface of the panel assembly 60 may extend upward to pass through the cable inlet 714'. The cable 621 may extend upward in the state of being in contact with a rear surface of the upper frame 71 and then pass through a cable outlet 717 provided in a barrier 713 and be inserted into the PCB accommodating space 710.

Also, insulators 531, 532, and 533 may be disposed on the sub-door 50. The insulators 531, 532, and 533 may be assembled and mounted on the sub-door 50 in a state of being already molded to match an inner shape of the sub-door 50.

Particularly, the insulator 53 may be mounted on the upper portion of the sub-door 50 on which the cable 621 is disposed. In detail, the cable 621 having a flat shape may extend upward in a state of being in close contact with a rear surface of the upper frame 71. Also, the insulators 532 and 533 may be inserted and mounted in a shape corresponding to a space between an upper portion of the panel assembly 60 and a lower portion of the barrier 713. Thus, the cable 621 may extend upward through the upper frame 71 and the insulators 532 and 533.

Also, the door liner 52 may be assembled in a state in which the insulators 531, 532, and 533 are inserted and mounted. Of course, in a state in which at least a portion of the insulator 532 is assembled with the door liner 52, the cable 621 may be connected to the upper frame 71.

Although the structure in which the panel assembly and the PCB are provided in the sub-door is described in embodiments, the structure may be equally applied to a refrigerating compartment door provided as a single door.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet defining a storage space; and a door configured to open and close the storage space, wherein the door comprises:

an outer plate that at least partially defines a front surface of the door and that defines a plate opening, a door liner that at least partially defines a rear surface of the door and that defines a liner opening, a panel assembly configured to shield the plate opening and the liner opening, the panel assembly comprising a display configured to (i) permit an inside of the refrigerator to be visible from an outside of the panel assembly, and (ii) output a screen through the display, an insulator disposed at the door, a frame positioned at a periphery of the panel assembly, and a frame cover mounted at the frame, wherein the frame comprises:

a panel assembly mounting part that mounts the panel assembly thereat, a barrier that partitions an inside of the door into (i) a printed circuit board (PCB) accommodating space that accommodates a PCB, and (ii) an insulator accommodating space that accommodates the insulator, and a cable guide part that is connected to the panel assembly mounting part and configured to receive a cable, the cable that connects the panel assembly to the PCB, and wherein the frame cover connects the cable guide part to the barrier in the insulator accommodating space and guides the cable from the cable guide part into the PCB accommodating space.

2. The refrigerator according to claim 1, wherein the cable guide part is recessed from a front surface of the frame and accommodates the cable.

3. The refrigerator according to claim 1, wherein the cable guide part includes a cable inlet that passes through the frame and is in fluid communication with an inside of the frame cover, the cable inlet configured to enable the cable to pass therethrough.

4. The refrigerator according to claim 3, wherein the frame includes a guide wall extending from the barrier and protruding along an inner circumference of the frame cover, and wherein the cable inlet is disposed inside the guide wall.

5. The refrigerator according to claim 1, wherein the barrier includes a cable outlet through which the cable passes, the cable outlet being in fluid communication with an inside of the frame cover.

6. The refrigerator according to claim 1, wherein the barrier extends from a first end to a second end of the frame and includes a pair of ribs and a barrier groove defined between the pair of ribs, and wherein the door liner includes a liner coupling part that is inserted into the barrier groove and coupled to the barrier.

7. The refrigerator according to claim 6, wherein the frame cover includes a pair of cover ribs being connected to the barrier at a position corresponding to a cable outlet, and wherein the liner coupling part is inserted into the barrier groove and the pair of cover ribs.

8. The refrigerator according to claim 6, wherein the barrier includes a plurality of reinforcement ribs extending in a protruding direction of the barrier at a bottom surface of the barrier.

9. The refrigerator according to claim 1, wherein the outer plate includes a bent plate part extending backward along a circumference of the plate opening, and wherein the frame defines a plate accommodating groove at a front surface of the frame, the plate accommodating groove being recessed along the periphery of the panel assembly and configured to receive the bent plate part.

10. The refrigerator according to claim 9, wherein the frame cover comprises:

a cover body accommodating the cable; and a cover edge positioned along a periphery of the cover body and mounted at a rear surface of the frame, the cover edge passing through the plate accommodating groove, wherein the cover edge defines a recess configured to be coupled to the plate accommodating groove.

11. The refrigerator according to claim 1, wherein the panel assembly comprises:

a front panel at least partially defining a front surface of the panel assembly and configured to shield the plate opening;

a rear panel being spaced apart from the front panel and at least partially defining a rear surface of the panel assembly, the rear panel being configured to shield the liner opening; and an outer frame connecting the front panel to the rear panel and at least partially defining a lateral surface of the panel assembly, wherein the display is provided between the front panel and the rear panel, and wherein the cable is connected to the display and extends between the front panel and the outer frame.

12. The refrigerator according to claim 11, wherein the panel assembly further comprises a touch screen disposed at a rear surface of the front panel and configured to sense a touch input at the front panel, and wherein the cable further comprises a touch cable connected to the touch screen.

13. The refrigerator according to claim 11, wherein the panel assembly further comprises:

a light guide plate disposed behind the display and configured to illuminate the display; and a display light provided at the outer frame and configured to irradiate light onto the light guide plate, wherein the cable further comprises a light cable connected to the display light.

14. The refrigerator according to claim 11, wherein the front panel has an area that is greater than an area of each of the rear panel and the display, and wherein the cable is disposed along a rear surface of the front panel.

15. The refrigerator according to claim 11, wherein the front panel comprises:

a see-through part through which the inside of the panel assembly is visible at a position corresponding to the display; and an opaque bezel disposed at a periphery of the see-through part, wherein the cable is disposed to pass through the opaque bezel.

16. The refrigerator according to claim 11, wherein the frame further comprises a panel support part extending to an outside of the panel assembly mounting part and configured to support the front panel at a rear side of the panel support part, and wherein an cable inlet is provided at the panel support part.

17. The refrigerator according to claim 1, further comprising:

an upper cap decoration coupled to an upper end of each of the outer plate and the door liner and defining a top surface of the door; and a decoration cover configured to open and close a decoration opening that is defined at a top surface of the upper cap decoration, wherein the decoration opening is in fluid communication with the PCB accommodating space.

18. The refrigerator according to claim 17, wherein the decoration cover comprises:

a shielding part configured to shield the decoration opening; and a PCB mounting part extending downward from the shielding part and mounting the PCB, wherein, based on the decoration cover being mounted to shield the decoration opening, the PCB is disposed inside the PCB accommodation space.

19. The refrigerator according to claim 1, wherein the cable comprises a flexible flat cable.

20. The refrigerator according to claim 1, wherein the door comprises:

a main door configured to open and close the storage space and defining a main door opening; and a sub-door configured to open and close the main door opening, wherein the sub-door comprises the outer plate, the door liner, the panel assembly, the insulator, and the frame.

* * * * *